US005470131A

United States Patent [19]

Nolan et al.

[11] Patent Number: 5,470,131

[45] Date of Patent: Nov. 28, 1995

[54] METHODS AND APPARATUS FOR CUTTING CIRCULAR SLOTS IN PAVEMENT EXTENDING ABOUT MANHOLE CASTINGS

[75] Inventors: Brian J. Nolan, Chardon; Glenn L. Mahaffey, Elyria; John M. Svoboda, Sr., Chardon, all of Ohio

[73] Assignee: Americore Technologies, Inc., Chardon, Ohio

[21] Appl. No.: 263,150

[22] Filed: Jun. 21, 1994

[51] Int. Cl.[6] ..... E01C 23/09

[52] U.S. Cl. ..... 299/41.1; 404/72

[58] Field of Search ..... 299/30, 39, 41; 404/72, 90; 175/402

[56] References Cited

U.S. PATENT DOCUMENTS

| | | | |
|---|---|---|---|
| 799,880 | 9/1905 | Tonge, Jr. | 175/323 |
| 2,088,141 | 7/1937 | Royston | 172/49.5 |
| 3,097,466 | 7/1963 | King | 56/12.6 |
| 3,217,620 | 11/1965 | Mindrum et al. | 404/90 |
| 3,243,924 | 4/1966 | Peters | 451/488 |
| 3,472,555 | 10/1969 | Theermann et al. | 299/41 |
| 3,649,071 | 3/1972 | Graff | 299/41 |
| 3,848,687 | 11/1974 | Funakubo | 175/394 |
| 3,917,426 | 11/1975 | Wohlweno et al. | 404/133.2 |
| 4,173,836 | 11/1979 | Paurat | 37/348 |
| 4,262,966 | 4/1981 | Bouplon | 299/39 |
| 4,287,955 | 9/1981 | Anderson | 172/98 |
| 4,332,299 | 6/1982 | Parks et al. | 172/98 |
| 4,458,949 | 7/1984 | Jury | 299/41 |
| 4,668,017 | 5/1987 | Peterson et al. | 299/37 |
| 4,723,868 | 2/1988 | Ferguson | 404/90 |
| 4,761,038 | 8/1988 | Hackmack | 299/10 |
| 4,896,995 | 1/1990 | Simmons | 404/90 |
| 4,924,951 | 5/1990 | Paulson | 175/57 |
| 4,968,101 | 11/1990 | Bossow | 229/41 |
| 5,176,426 | 1/1993 | Adamson | 404/90 X |

FOREIGN PATENT DOCUMENTS

| | | | |
|---|---|---|---|
| 2691180 | 11/1993 | France | 404/90 |
| 2242881 | 3/1974 | Germany | 404/90 |
| 2530225 | 1/1977 | Germany | 404/90 |
| 221777 | 5/1985 | Germany | 404/90 |
| 348382 | 10/1960 | Switzerland | 299/89 |

OTHER PUBLICATIONS

"Manholes Made Easy," *Asphalt Contractor*, pp. 62, 64—A Two Page Advertisement By RoadBadger, Inc. Burton, Ohio 44021 (1989).

"Manhole Master,"—A One Page Advertisement By RoadBadger, Inc, Burton, Ohio 44021 (1989).

"VACM–Vertical Asphalt Concrete Miller,"—A Four Page Brochure of RoadBadger, Inc., Burton, Ohio 44021 (1988).

*Primary Examiner*—David J. Bagnell

*Attorney, Agent, or Firm*—David A. Burge

[57] ABSTRACT

A self-propelled core-cutting apparatus is used to cut circular slots in pavement extending about manhole castings and the like to permit castings and surrounding cores of pavement to be removed quickly and easily for such purposes as elevating the level of manhole castings to align with new pavement. The apparatus has a transport carriage to which are connected 1) a large diameter, generally cylindrical core-cutting bit, 2) power-operated support and drive systems mounting the bit for vertical and rotary movement relative to the carriage along and about a vertically extending center axis, and 3) a power-operated stabilization system that makes use of the weight of the apparatus in maintaining desired positioning of the apparatus during cutting operations. Support for the core cutting bit is provided by a telescopically extensible array of cage-like structures that extend substantially concentrically about the center axis, including an outer cage that is rigidly connected to the carriage, and an inner cage that is movable vertically relative to both the outer cage and the bit. Job site positioning of the apparatus is effected by using lever or joystick controls to operate a fluid-motor-driven power-steerable wheel that also serves as one of three vertically movable components of the power-operated stabilization system. Preferred practice of the invention also makes use of other disclosed features.

70 Claims, 10 Drawing Sheets

METHODS AND APPARATUS FOR CUTTING CIRCULAR SLOTS IN PAVEMENT EXTENDING ABOUT MANHOLE CASTINGS

BACKGROUND OF THE INVENTION

1. Field of the Invention

The present invention relates to the cutting of circular slots in paved "traffic surfaces" that extend about manhole castings and the like to permit castings and surrounding cores of pavement to be removed quickly and easily for such purposes as elevating the level of manhole castings to align with new pavement. More particularly, the present invention relates to the use of a novel and improved core-cutting apparatus to cut circular slots in traffic surfaces wherein the apparatus has a transport carriage to which are connected operating components that typically include a large diameter, generally cylindrical core-cutting bit, power-operated support and drive systems that mount the bit for vertical and rotary movement relative to the carriage along and about a vertically extending center axis, and a power-operated stabilization system that makes use of the weight of the apparatus in maintaining desired positioning of the apparatus during cutting operations.

2. Prior Art

The term "traffic surface" is used in this document in a generic sense to refer to a wide class of substantially horizontally extending paved surfaces such as highways, streets, driveways, parking lots, runways, taxi-ways, tarmacs, floors of large garages and industrial buildings, loading dock decks, and the like that have metal castings or other structures installed therein to define manholes, catch basins, access openings for valves, fluid supply connections or water or fuel, electrical supply connectors and the like.

Because traffic surfaces are exposed to wear and often to the effects of the elements, they are subject to deterioration and periodically require repair and/or resurfacing, typically by installing one or more additional layers of paving material such as asphalt atop portions of existing pavement. When pavement is to be replaced or pavement layers are to be added, it is customary to remove installed metal castings by utilizing impact tools such as jackhammers to break existing pavement from about the castings so that the castings can be removed and reinstalled, often accompanied by "riser" castings designed to aid in accommodating the level of new pavement.

The use of jackhammers to effect pavement removal from about installed manhole castings and the like is both "time intensive" and "labor intensive" in that it typically requires an hour or more of relatively strenuous work by at least two people. Operating a jackhammer is physically taxing in that it quickly tires workers, risks the onset of back problems and other possible injuries, creates a high level of noise, often releases undesirably large quantities of dust into the air, and tends to cause chips and small pieces of hard material to be discharged about the job site so as to pose a hazard not only to workmen but also to passers by.

Using a jackhammer to break apart pavement to facilitate its removal also tends to have a number of deleterious effects on surrounding pavement that is left in place. Pavement left in place typically has rough, structurally weakened edge regions wherein hairline cracks are formed that can lead to leaching and to the formation of cracks of far greater size. Reinforcing rods located in pavement that remains in place often have been undesirably loosened by jackhammer usage. Moreover, as the use of a jackhammer almost invariably leads to some greater pavement breakage than is desired, more pavement than is necessary tends to be removed, which not only adds significantly to the cost of pavement replacement but also causes larger than necessary piles of broken pavement to accumulate—accumulations that need to be removed before proper traffic flow can safely be restored. Clearly a pavement removal technique that is more in line with preserving the structural integrity of roadway infrastructure is desired.

In recognition of such drawbacks as are mentioned above, a variety of forms of apparatus have been proposed that are intended to be capable of cutting circular slots in pavement to permit removal of manhole castings and the like together with cores of surrounding pavement material. However, such proposals typically have exhibited one or more drawbacks—drawbacks that have been deemed to be sufficiently serious in nature to prevent widespread acceptance.

For example, in an effort to provide core-cutting apparatus that easily can be moved from one job site to another, an approach taken by some proposals has been to provide a relatively lightweight unit that includes a relatively large diameter core-cutting bit and a supporting frame of relatively small size that is configured to permit the unit to be mounted as an "attachment" on various forms of construction equipment such as trucks, tractors and road graders. Prevalent among drawbacks that tend to be exhibited by such proposals is the tendency of the provided apparatus to be so light in weight and lacking in rigidity that the generation of a proper type of cutting action tends to be inhibited by chatter and vibration of the bit, and by failure to provide sufficient stabilization to ensure that proper positioning of the bit is maintained during the time that is required to cut circular slots of proper depth.

The presence of vibration, and the lack of needed support and stabilization for a core-cutting bit can result in undesired "walking" of the bit and in undesired movement of the apparatus. The effect of unwanted movement of the apparatus during operation of the bit not only tends to cause improper types of core cutting to result, but also tends to cause undue wear on the bit, tooth breakage, bit failure and/or undue wear on components of the apparatus that mount and operate the bit.

Not provided by prior proposals is an apparatus that can be transported expeditiously between job sites, that can be quickly and effortlessly positioned and repositioned at a job site to perform core cutting operations about a series of spaced manholes, that will, with reliable stability, maintain desired operating positions without "walking" or otherwise moving about while cutting is underway, and that will repeatedly perform properly (without encountering frequent tooth breakage or other bit damage) to efficiently precision-core one manhole after another.

SUMMARY OF THE INVENTION

The present invention addresses the foregoing and other needs and drawbacks of the prior art by providing novel and improved methods and apparatus for cutting circular slots in pavement that extends about existing manhole castings and the like to permit castings and surrounding cores of pavement to be removed quickly and easily for such purposes as elevating the level of manhole castings to align with new pavement.

A core-cutting machine that embodies features of the preferred practice of the present invention includes a rugged transport carriage to which are connected 1) a relatively large diameter, generally cylindrical core-cutting bit, 2) power-operated support and drive systems that mount the bit for vertical and rotary movement relative to the carriage along and about a vertically extending center axis, and 3) a power-operated stabilization system that makes use of the weight of the machine in maintaining desired positioning of the machine during cutting operations.

In preferred practice, the transport carriage is designed 1) to permit the machine to be quickly and easily transported "over the road" between and among job sites, 2) to permit the machine to be safely and effortlessly maneuvered and properly positioned (i.e., typically by positioning the machine to appropriately overlie one manhole after another) at a job site, and 3) to permit the properly positioned machine to be supported with unprecedented stability during the conduct of cutting operations.

For transport, the carriage preferably is provided with a commercially available hitch assembly that incorporates a brake actuation unit, and with left and right over-the-road transport wheels equipped with hitch-actuated brakes to permit the relatively heavy machine to be safely towed. The carriage also preferably carries an extensible-retractable front wheel (situated near the front of the carriage) that can be used to raise or lower the height of the hitch to assist in coupling the hitch to a motor vehicle. For supporting front portions of the machine when the machine is parked, both the front wheel and an extensible and retractable carriage-carried safety stand are provided; and, the front wheel has a "normally on" braking system that can be utilized to assist in maintaining the position of the machine when the parked machine is not connected by the hitch assembly to a brake-equipped vehicle.

For moving and positioning the machine at a job site, the carriage preferably is provided with an engine that can be operated to "self-propel" the machine. The engine preferably operates a fluid pump for supplying pressurized fluid (preferably hydraulic fluid) to a pair of fluid-operated units (preferably a hydraulic motor and a hydraulic cylinder) that are connected to the front wheel to drive and steer the front wheel. While lever-operated controls are provided that can be utilized to cause the fluid-operated units to execute drive and steer commands, a "joystick" type of control that is releasably connected to the machine by a flexible control cable also is provided to permit an operator to stand back at a safe distance from the machine so that a good view of the machine and any surrounding obstacles is afforded while the machine is being maneuvered, positioned and repositioned at a job site.

For stabilizing the machine during cutting operations, the carriage preferably is provided with a pair of power-operated, extensible and retractable stabilization stands that are utilized together with the extensible and retractable front wheel to raise the carriage so that its left and right transport wheels provide no support, whereby a highly desirable type of "three point" support is provided at locations that define an acute triangle that is substantially centered about the axis of rotation of the cutting bit. Lever-operated controls and hydraulic cylinders preferably are provided to extend and retract the front wheel and the support stands so that substantially the full weight of the relatively heavy machine will be supported at three points arrayed about the axis of rotation of the rotary cutter bit when this very stable type of support is brought into play.

Also contributing to the stabilization of the heavy cylindrical coring bit during cutting operations is a ruggedly constructed carriage-carried set of telescopically interconnected cage-like structures that mount and vertically position the rotary bit. An outer cage is provided that extends upwardly from and is rigidly connected to the transport carriage. An inner cage is nested within the confines of the outer cage and is movable vertically relative to the outer cage. Bit support structure is nested within the inner case and is movable vertically relative to the inner cage. The positioning of the inner cage and of the cutting bit relative to the outer cage (i.e., relative to the transport carriage) is controlled by operating a hydraulic cylinder that vertically positions the bit relative to the outer cage. As the bit rotates to cut a circular slot in traffic surface pavement underlying the transport carriage, the bit is moved downwardly under operator control to ensure optimal cutting performance.

In preferred practice, the locations of various carriage mounted components (such as the bit and its supporting structure, the engine, a fuel tank for the engine, the fluid pump and a fluid reservoir, etc.) are selected to provide properly balanced loading of the carriage and its transport wheels, with only a relatively nominal portion of the weight of the machine being delegated to be supported by a hitch-connected motor vehicle during transport of the machine from place to place. The selected arrangement of components also causes the front wheel of the machine to support a sufficient amount of machine weight to ensure good traction when the front wheel is driven and steered to position the machine at a job site. Likewise, the locations of the power-extended stabilization stands and the front wheel are selected so that a desired type of "three point support" is provided for the machine during cutting operations to effectively utilize the weight of the machine to ensure stability and optimum cutting performance.

The "three point" character of the support that preferably is utilized by the described machine is not limited in its applicability to the manner in which the transport carriage is supported atop a traffic surface during cutting operations. In preferred practice, other sets of three-point support components are utilized to support the rotary cutter bit on the transport carriage. For example, one set of three support components that define a triad of movable connections is interposed between the relatively vertically movable outer and inner cage structures (described previously); and, another set of three support components that define another triad of movable connections is interposed between the relatively vertically movable inner cage structure and such structure as rotatably mounts the rotary cutter bit. The connections provided by each of these sets are triangularly arrayed about the center axis of the rotary bit—and the character of these connections (features of which are described later in this document) contribute to the provision of an extraordinarily stable type of support for the rotary cutter bit.

A significant feature of the present invention resides in the relatively clean, relatively smooth cut that is provided by the very stable, very ruggedly supported rotary cutter bit. The cleanly sawed circular slot that typically is formed by the bit leaves little if any debris that needs to be shoveled aside or hauled away. Cored manhole structures do not necessarily obstruct traffic, but rather are usually sufficiently stable to safely be left in place (even with traffic passing thereover) until it becomes convenient to effect removal and replacement. The thin circular slot that is formed by the rotary cutting bit usually poses no hazard to vehicle traffic— which permits use of the machine to core a large number of manholes that later can be serviced to extract and repair or replace castings and cored pavement.

Operation of the core cutting machine typically requires only about nine to about twelve minutes of "set up time" to position the machine for operating at a job site to which the machine has been towed. The machine requires only one operator, does not require "heavy labor" to be performed by the operator, and is sufficiently easy to use so that an operator typically can core approximately fifty manholes per working day, with each of the coring operations typically requiring less than ten minutes.

Once a circular slot has been cut through pavement surrounding a manhole casting, the annular core of pavement material easily can be lifted out of the newly-cut hole using a backhoe or by utilizing the lifting capability of the power-operated stabilization stands to raise the transport carriage to pull upwardly on one or more chains that depend from the carriage for connection to core material and/or a casting that is to be lifted.

If a manhole casting that is removed from a cored manhole remains in sufficiently good condition to permit its reuse, it usually is reused. Unwanted pavement pieces clinging to the casting typically can be removed with ease, utilizing a sledge hammer or jackhammer. If a manhole site is simply being repaired, the base of brick or other material that underlies the manhole casting is repaired or replaced, as needed, so that the manhole casting will be seated on a sound base when it is next enveloped by pavement. If a manhole site is to be repaved, the base of brick or other material that underlies the manhole casting usually is raised or replaced, as needed, so that the manhole casting will be seated on a sound base and at a proper height when it is next enveloped by pavement.

Still another significant feature of the preferred practice of the present invention has to do 1) with the manner in which the transport carriage is configured, and 2) with the relatively rearward carriage location that is chosen for mounting the rotary cutter on the transport carriage—both of which factors are utilized to good advantage in providing the machine with a cutting bit that easily can be replaced when needed. By locating the rotary cutter toward the rear of the transport carriage, and by configuring rear portions of the transport carriage so that they do not extend downwardly as far as do other components of the carriage, bit replacement can be carried out quite quickly and easily 1) by parking the rotary cutter bit (usually a relatively tall, generally cylindrical structure that weighs several hundred pounds) of the machine on a traffic surface, 2) by disconnecting the parked bit from its drive and support structure, 3) by driving the machine forwardly to cause the parked bit to pass beneath rear portions of the transport carriage, 4) by maneuvering the machine and driving the machine rearwardly to cause a parked replacement bit to pass beneath rear portions of the transport carriage, and 5) by attaching the replacement bit to the bit's drive and support structure.

Still another feature of the present invention relates to the provision of a simply configured carriage-connected conduit to which a water supply hose can be connected for delivering water to vanes that populate an upwardly facing surface of the rotary cutter bit. The conduit preferably is connected to the inner cage (of the telescopic set of cage structures that raises and lowers the bit) for movement with the inner cage so that a discharge end of the conduit will be suitably positioned to direct water onto the vaned upper surface of the bit. The vanes of the bit are configured to duct a plurality of flows of water through holes provided in the bit so that the region of operation of the bit will receive a needed flow of water to cool the bit and to flush away debris.

Described later in this document are a number of other features that are included within the spirit and scope of the present invention. Some of these features relate to methods of coring manholes in the general manner that is described above—methods that typically call for use to be made of apparatus features of the general type that are described above.

BRIEF DESCRIPTION OF THE DRAWINGS

The foregoing and other features of the invention will be better understood by referring to the description of the preferred embodiment and the claims which follow, taken together with the accompanying drawings, wherein:

DESCRIPTION OF THE PREFERRED EMBODIMENT

Figure 1:
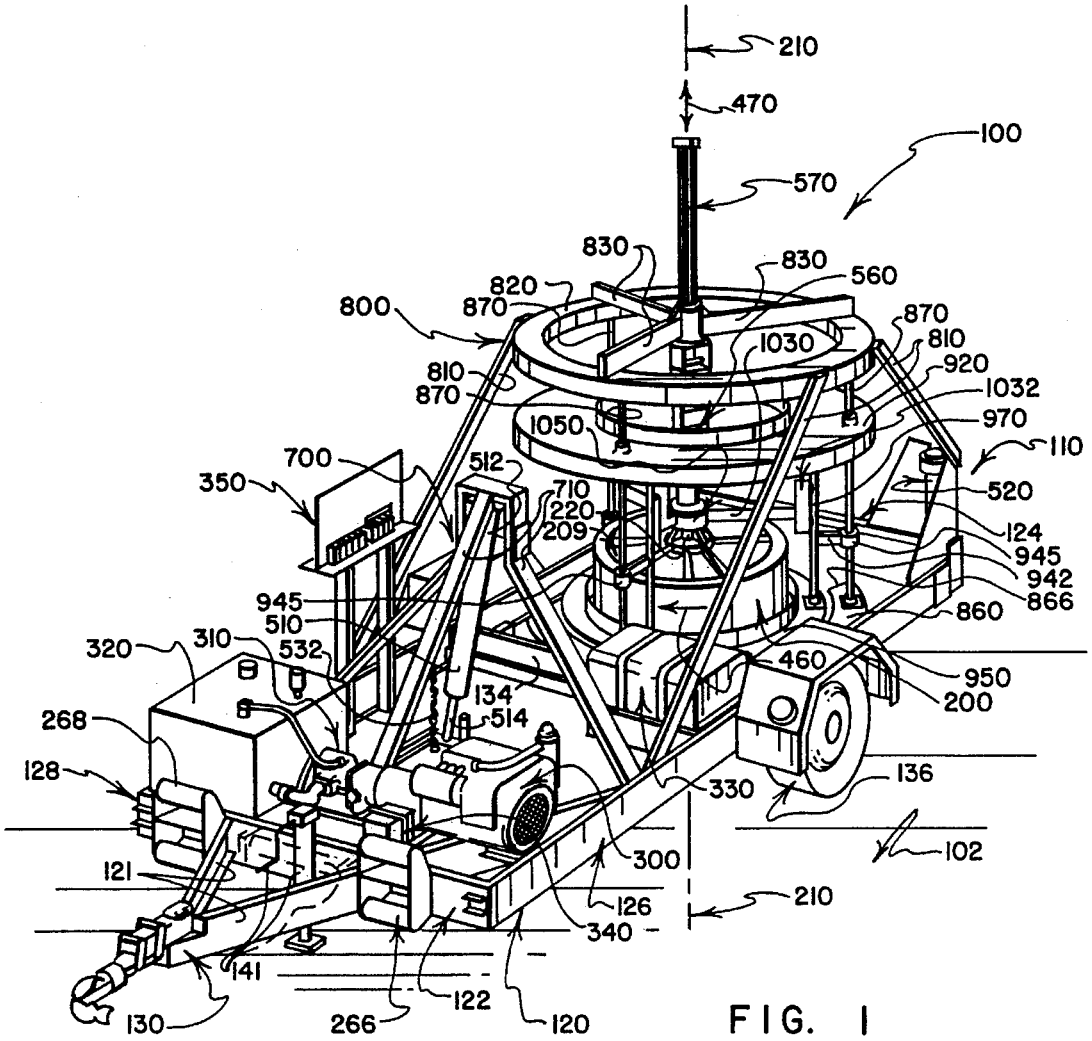
FIG. 1 is a perspective view of a coring machine that embodies one form of preferred practice of the present invention supported on a traffic surface, with the view showing principally front and left side portions of the machine, with a safety support stand located near the machine's hitch extended to cooperate with left and right transport wheels in supporting the weight of the machine, with the machine's rear mounted, power operated stabilization supports retracted to their transport positions, with the machine's rotary cutter bit raised to its transport position, and with some components of the machine such as hydraulic hoses and the like being broken away to permit other components to be more meaningfully depicted.
Figure 2:
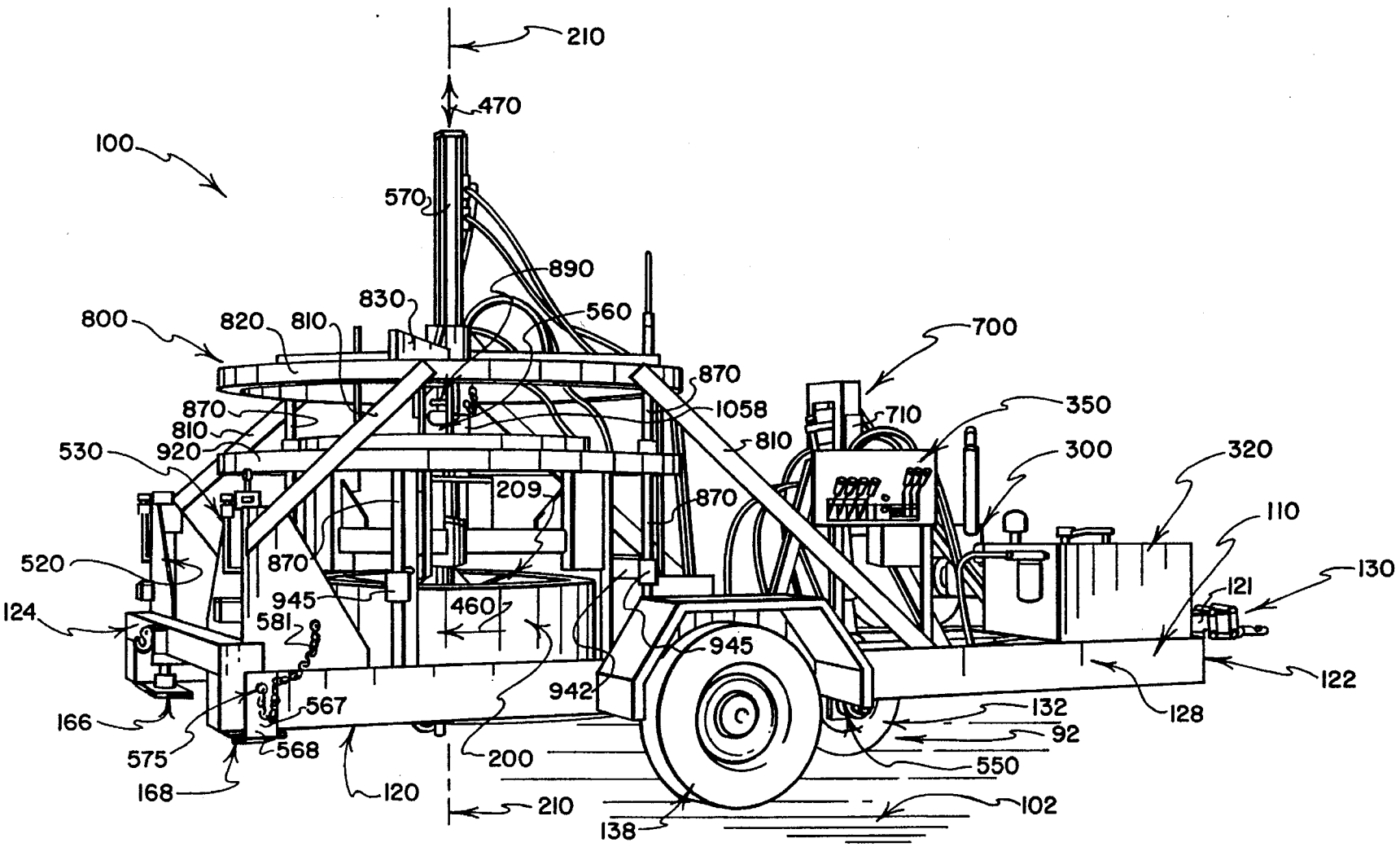
FIG. 2 is a perspective view of the machine supported on a traffic surface, with the view showing principally rear and right portions of the machine, with components of the machine positioned as shown in FIG. 1 except that the weight of the machine is being supported by the machine's left and right transport wheels, and by a retractable front wheel.
Figure 3:
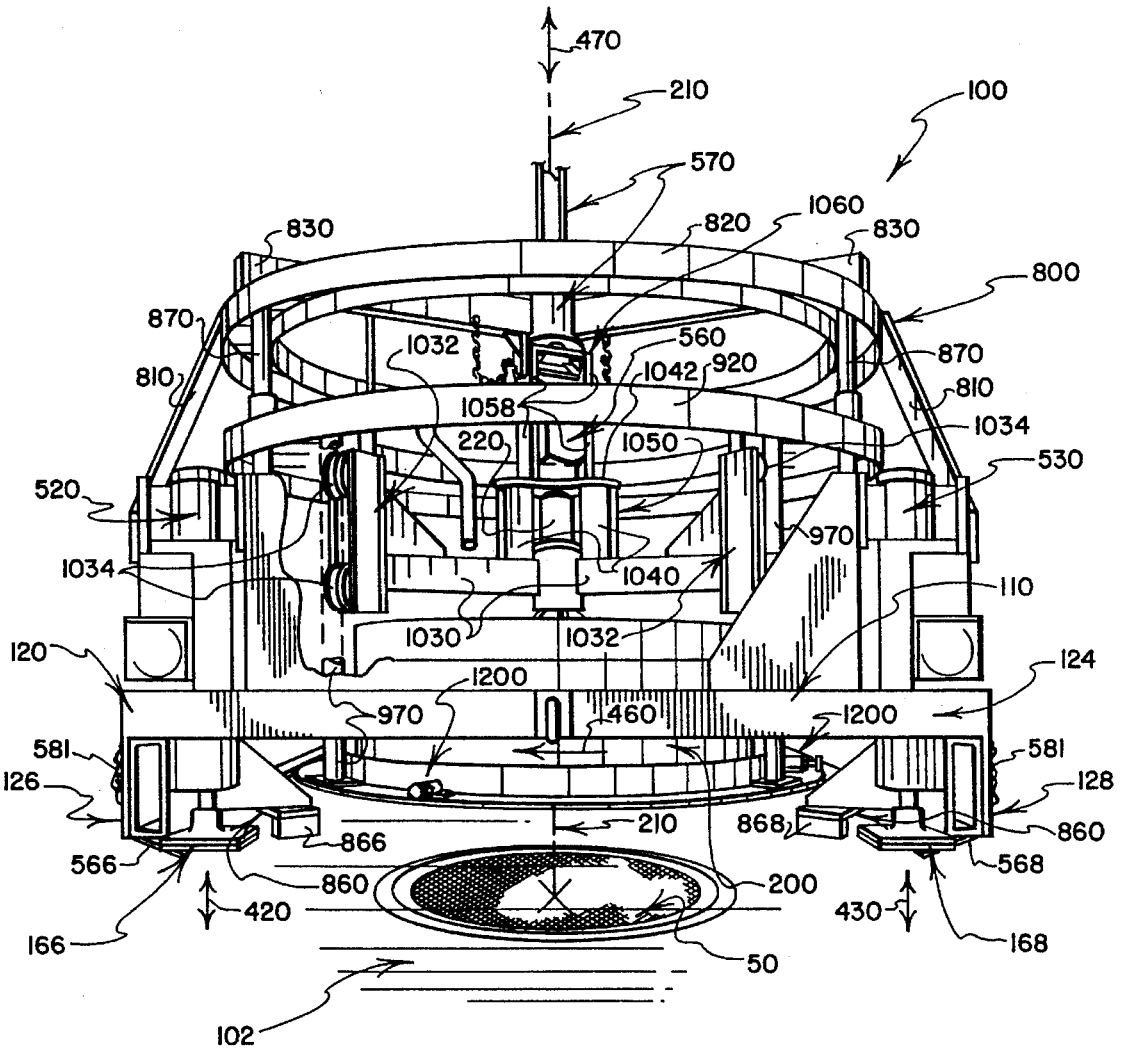
FIG. 3 is a rear perspective view on an enlarged scale depicting selected components of the machine, with the machine's power operated stabilization supports shown retracted to their transport positions, with the machine's rotary cutter bit shown raised to its transport position, and with the machine's rotary cutter bit shown centered above a manhole—illustrating how the machine typically is positioned when a manhole is to be cored.

Referring to FIGS. 1–3, a machine that embodies the best mode known for carrying out the preferred practice of the present invention is indicated generally by the numeral 100. The machine 100 is shown positioned atop a traffic surface 102. The machine 100 includes a wheeled transport carriage 110 having a front wheel 132 and left and right transport wheels 136, 138. The carriage 110 mounts a generally cylindrical core-cutting bit 200 together with an engine 300 and other components (described later herein) that enable the machine 100 to be positioned and operated to rotate and move the bit 200 about and along a generally vertically-extending center axis 210 for the purpose of cutting circular slots in traffic surface pavement that extends about pavement-embedded manhole castings (one of which is indicated by the numeral 50 in FIG. 3) for the purpose of permitting manhole castings and surrounding pavement to be removed so that the castings can be repaired, replaced and/or properly positioned to align with the level of newly installed pavement.

The description that follows focuses in some detail 1) on differing ways in which the transport carriage 110 is supported atop the traffic surface 102, 2) on a variety of provisions that are made to ensure that the rotary core-cutting bit 200 is supported with maximum stability to carry out core-cutting operations, and 3) on the diverse uses that are made of a front wheel 132 of the machine 100 not only to provide carriage support but also to steer and drive the machine 100 during job-site maneuvers, and to contribute to the vertical positioning of machine components—for a number of novel features of the invention relate to these topics.

As will be explained, three differing modes of carriage support are provided—each of which provides, what, in essence, can reasonably be described as support that is of "three point" character. One "three point" mode of carriage support is provided when the machine 100 is being towed during over-the-road travel to and from job sites. A different mode of "three point" carriage support is provided when the machine 100 is being moved about a traffic surface 102 in a self-propelled manner to position the machine 100 at a job site for carrying out coring operations. Still another, highly stable, immovable mode of "three point" carriage support is provided when the machine 100 is being operated to rotate the core-cutting bit 200 to cut a circular slot in traffic surface pavement that extends about a manhole.

As also will be explained, "three point" support of still another character is provided to movably mount the rotary core-cutting bit 200 on the carriage 110 so that the bit 200 can be vertically positioned along its center axis 210 while also being rotated about the center axis 210—with the support's "three point" nature contributing significantly to the bit's smooth movement and highly stable operation.

Because it is not possible to clearly depict all of the components of the machine 100 in a single view, the following guidelines will assist the reader in selecting the view or views in which a particular component is likely to appear. Front and left components of the machine 100 tend to be best depicted in FIG. 1. Rear and right components tend to be best depicted in FIG. 2—except that some rearwardly-situated components may be more clearly depicted in rear views that are provided by FIGS. 3 and 4. General arrangements of major components, and the nature of relative movements that can take place between certain components are depicted in the schematic top view of FIG. 5 and in the schematic right side view of FIG. 6. FIGS. 7–20 are provided to illustrate particular features, and will be referred to specifically when appropriate.

Referring variously to FIGS. 1–6, it will be seen that the transport carriage 110 of the machine 100 includes a frame 120 that is formed as a welded steel assembly. The frame 120 has a generally rectangular shape, best seen in FIG. 5. The frame 120 has a front end region 122, a rear end region 124, a left side region 126 and a right side region 128. The frame 120 has a length (measured from front to rear) that is more than twice its width (measured from left to right).

While features of the present invention can be utilized with core cutting machines that employ rotary core-cutting bits of a variety of sizes, the machine 100 is comprised of components that are sized most appropriately for use with a core-cutting bit 200 that has a outer diameter of about forty eight inches—for cutting circular slots that have diameters of about forty eight inches. When the machine 100 supports a rotary core-cutting bit 200 having a diameter of about forty eight inches, the generally rectangular frame 120 preferably has a length of about seventeen and a half feet and a width of about six feet, with the location of the bit rotation axis 210 preferably being about thirteen and a half feet from the front end region 122 of the frame 120 and about four feet from the rear end region 124 of the frame 120. By utilizing the dimensional information just provided, and by taking into account that the drawings (with the exception of the schematic depictions that comprise FIGS. 5–6) are drawn largely to scale, it will be understood that the preferred relative sizes of other components of the machine 100 can be discerned from the drawings.

A lengthy discussion of details of the machine 100 begins shortly. However, before details are presented, a few words of "overview" will be provided so that a number of major components can be identified that will need to be referenced when more detailed features are discussed.

Referring to FIGS. 1 and 2, two upstanding structures 700, 800 are supported with such rigidity by the frame 120 as to, in essence, comprise integral portions of the frame 120. The structure 700 includes a plurality of heavy, inclined brace members 710 that are connected at their lower end regions to front, left and right parts 122, 126, 128 of the frame 120, and converge at their upper end regions to connect with an upper end region 512 of a fluid-operated cylinder assembly 510 that overlies a front wheel 132 of the machine 100. The structure 800 includes a plurality of heavy brace members 810 that are connected at their lower end regions to left, right and rear parts 126, 128, 124 of the frame 120, and at their upper end regions with an upper ring member 820. Nested below the upper ring member 820 is a set of complexly configured, telescopically interconnected "three-point" support components that cooperate to provide a rugged, highly stable type of support to the rotary core-cutting bit 200—movable support that permits the rotary cutter bit 200 to be rotated about the center axis 210, and to be raised and lowered along the center axis 210.

Referring to FIG. 1, three horizontal members 830 1) that extend radially with respect to the center axis 210, 2) that connect at their outer ends with the ring member 820, and 3) that converge at their inner ends to provide support for a fluid-operated cylinder 570. The cylinder 570 extends upwardly along the axis 210, and functions to move and position the rotary core-cutting bit 200 along the axis 210, as is indicated by a double-headed arrow 470. Provided at a location beneath the cylinder 570 is a fluid-operated motor 560 that functions to rotate the bit 200 about the axis 210 in a direction that is indicated by an arrow 460.

Figure 4:
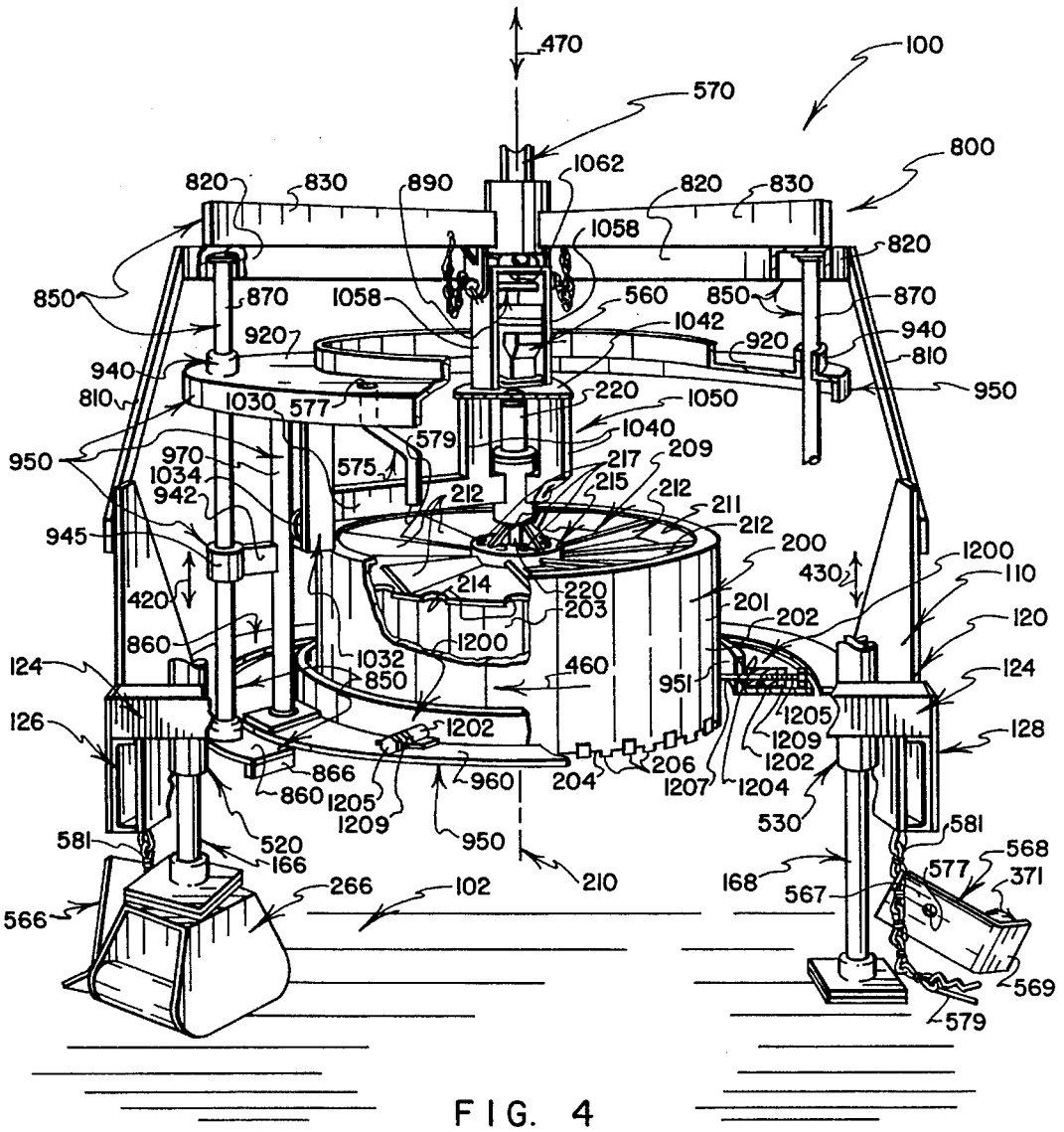
FIG. 4 is a rear perspective view similar to FIG. 3 but with the machine's power operated stabilization supports extended to carry portions of the weight of the machine, and with selected components removed and/or broken away to permit underlying features to be viewed.

Referring to FIGS. 1, 2 and 4, power to operate a number of components of the machine 100 such as the fluid-operated motor 560 and the fluid-operated cylinder 570 is provided by a number of commercially purchased power system components that are supported by the carriage 110. These power system components include an engine 300, an engine-driven fluid pump 310, a fluid system reservoir 320, a fuel tank 330 for supplying fuel to the engine 300, and a battery 340 for providing electrical energy to power electrical needs of the machine 100, for example to supply power to an electric starter of the engine 300.

Figure 20:
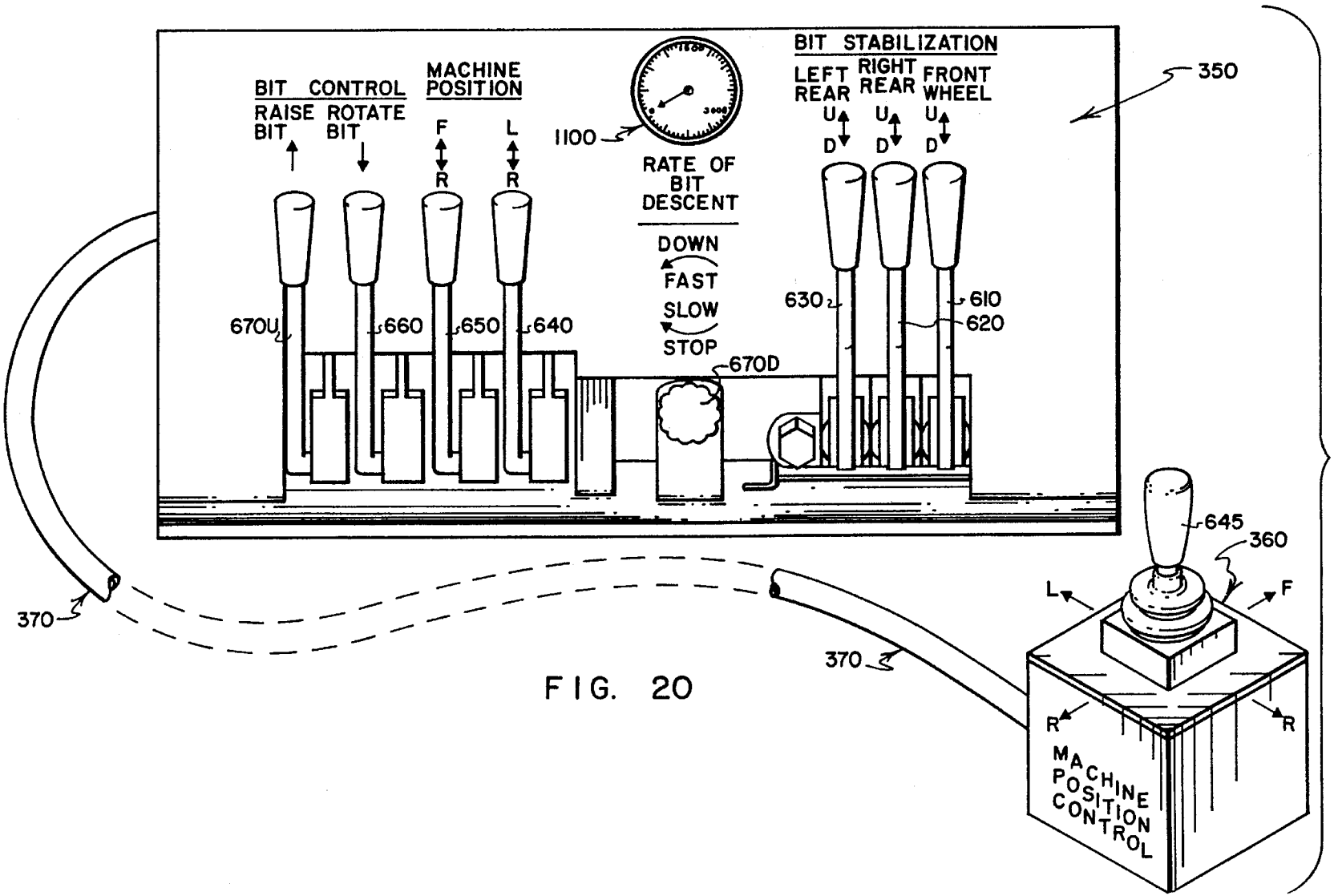
FIG. 20 is a perspective view showing various operational controls of the machine.

Referring to FIG. 2, a control panel 350 is supported mid-way along the left side of the frame 120. Referring to FIG. 20, the control panel 350 (and a "joystick" control unit 360 that is connected by a flexible signal-transmitting cable 370 to the control panel 350) provide movable lever controls 610, 620, 630, 640, 650, 660 and 670U, a rotatable knob control 670D, and a "joystick" lever 645 that operate fluid-driven units 510 (FIGS. 1, 7–10), 520 (FIGS. 1–5), 530 (FIGS. 3–5), 540 (FIGS. 7–8), 550 (FIGS. 2, 7–10), 560 (FIGS. 1–4), 570 (FIGS. 1–4) to execute the various functions of the machine 100, as will be more fully described later herein.

As those who are skilled in the art will understand, the engine 300 is selected to provide a power output of sufficient magnitude to drive the fluid pump 310 to supply and circulate fluid (typically hydraulic fluid) to and from the reservoir 320 for actuating the various fluid-driven units 510, 520, 530, 540, 550, 560, 570 to execute relative movements of various machine components, as represented by arrows 410, 420, 430, 440, 450, 460, 470, respectively—as will be more fully described later herein. In preferred practice, a gasoline engine having a nominal power output of no less than about 35 horsepower is selected. In preferred practice, the lever-operated controls 610, 620, 630, 640, 650, 660, 670U are selected to have a so-called "deadman" feature that biases their control levers toward non-operated positions (depicted in FIG. 20) for moving the control levers to their non-operated positions in the absence of the application to the levers of suitable actuating force by an operator.

Referring to FIG. 1, removably carried by the front part 122 of the frame 120 are a pair of ruggedly constructed portable stands 266, 268. The portable stands 266, 268 are welded steel structures that have no relatively movable parts, and that optionally can be used in conjunction with extensible and retractable stabilization stands 166, 168 for being interposed between base portions of the stabilization stands 166, 168 and the traffic surface 102. In FIG. 4 one of the portable stands 166 is shown interposed between the stabilization stand 166 and an underlying traffic surface 102.

The Carriage 110 and Its Modes of Support

Extending forwardly from the front end region 122 of the frame 120 is an "A-shaped" structure 121 that mounts a conventional, commercially purchased hitch assembly 130 for use in coupling the machine 100 to a truck or other form of over-the-road vehicle (not shown) so that the machine 100 can be towed expeditiously, in the manner of a trailer, to and from job sites.

Figure 5:
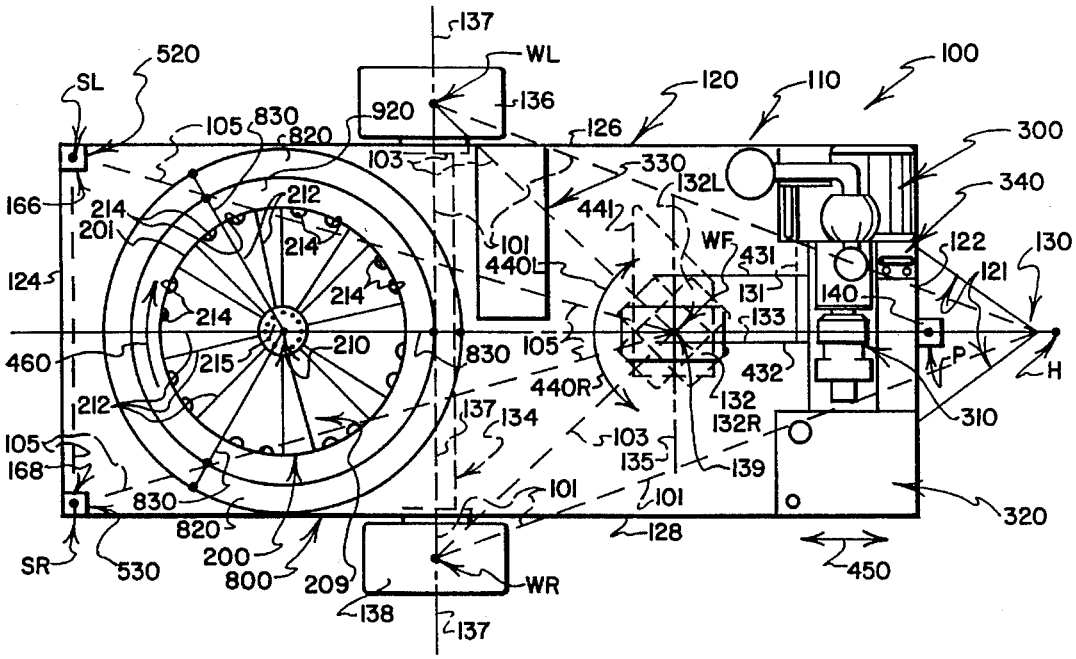
FIG. 5 is a top view that schematically depicts selected components of the machine and identifies various locations at which the machine is supported 1) when being towed by an over-the-road vehicle, 2) when being maneuvered under its own power at a job site, and 3) when stabilizing the rotary core-cutting bit during a core-cutting operation.

Referring principally to FIG. 5, the wheeled transport carriage 110 also includes left and right transport wheels 136, 138. The wheels 136, 138 are utilized in conjunction with the hitch 130 to support the weight of the machine 100 when the machine 100 is being towed to and from job sites.

In the simplified schematic view of FIG. 5, three "points of support" are designated by the letters "H," "WL" and "WR" to represent approximately the locations at which the hitch 130, the left wheel 136 and the right wheel 138 provide support for the machine 100 when the machine 100 is hitch-connected to a motor vehicle (not shown) for towing to and from job sites (i.e., for "over the road" travel). The three support points "H," "WL" and "WR" can be thought of as defining the three vertices of an imaginary "transport triangle" that is indicated by the numeral 101.

A notable characteristic of the transport triangle 101 is that its location overlies principally the front half of the frame 120. Stated in another way, all three of the support force loci "H," "WL" and "WR" (that represent the mode in which the machine 100 is supported in a "three point" manner for "over the road" travel) are spaced substantially forwardly with respect to the location of the center axis 210 of the rotary core-cutter bit 200.

When the machine 100 is hitch-connected to a motor vehicle for towing, the left and right transport wheels 136, 138 are called upon to support the vast majority of the weight of the machine 100—which is to say that the hitch 130 transfers only a small fraction of the weight of the machine 100 to a motor vehicle (not shown) that tows the machine 100. The imposition of the vast majority of the weight of the machine 100 on the transport wheels 136, 138 (with but a relatively small amount of machine weight—typically less than about four hundred pounds—being transferred through the hitch 130 to a hitch-connected motor vehicle) provides a very desirable type of force distribution for the machine 100 during "over the road" travel.

When the machine 100 is not hitch-connected to a motor vehicle but nonetheless has a substantial portion of its weight supported by the left and right transport wheels 136, 138, the remainder of the weight of the machine 100 can be supported by either or both of two frame-carried members that are mounted on the frame 120 for extension and retraction, namely the front wheel 132 and a safety stand 140.

In FIG. 1, the safety stand 140 is depicted 1) by solid lines as being oriented substantially vertically in its extended position (wherein the base of the safety stand 140 engages the traffic surface 102 to support a portion of the weight of the machine 100), and 2) by hidden lines as being oriented substantially horizontally in its retracted position (wherein the safety stand 140 is nested within the confines of the A-shaped structure 121 so as to be readily available for use when needed).

Figure 6:
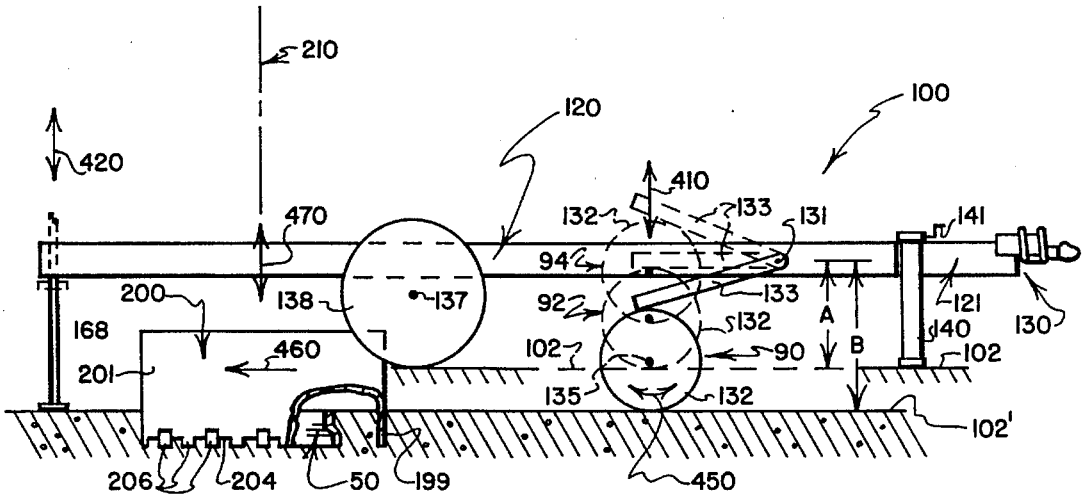
FIG. 6 is a schematic side elevational view depicting some positions of relatively movable components and structures in solid lines, and depicting other relative positions thereof in hidden lines, with the machine's rotary cutting bit shown in a typical core-cutting position forming a circular slot in traffic surface pavement underlying the machine.

Referring to FIG. 6, the safety stand 140 is depicted in its extended position for cooperating with the left and right transport wheels 136, 138 to support the frame 120 of the machine 100 at a height that is indicated by the dimension "A" atop a traffic surface segment that is indicated by the numeral 102. In FIG. 5 a point designated by the character "P" represents the locus of a support force that is provided by the safety stand 140 when the stand 140 is extended and assists in supporting machine weight.

In preferred practice the safety stand 140 takes the form of a commercially purchased assembly that is provided with a crank 141 that cooperates with internal mechanism (not shown) of the stand 140 to permit the length of the stand 140 to be adjusted to a limited extent so that the height at which the stand 140 supports the hitch assembly 130 can be adjusted by rotating the crank 141. This feature principally finds use when the hitch assembly 130 is to be connected to or disconnected from a motor vehicle (not shown)—which may necessitate raising or lowering of the hitch 130 through a limited range of movement. The extensible and retractable front wheel 132 also can be utilized, if desired, to raise and lower the hitch assembly 130.

The front wheel 132 has many associated features that will be described more completely later in this document. In FIGS. 5 and 6 the front wheel 132 is depicted in solid lines as being positioned to cooperate with the left and right transport wheels 136, 138 to support the machine 100 for forward and rearward movements (i.e., the front wheel 132 is shown in a "straight ahead" orientation wherein the axis 135 of rotation of the front wheel 132 parallels the axis 137 of rotation of the wheels 136, 138).

Also schematically depicted in FIGS. 5 and 6 is a front wheel support 133 that pivots relative to the frame 120 about a transversely extending axis 131 for mounting the front wheel 132 for extension and retraction movements with respect to the frame 120. While the so-called "extension" and "retraction" movements of the front wheel 132 are not strictly "vertical" in character (i.e., these movements more correctly are "arcuate" in nature inasmuch as "raising" and "lowering" of the front wheel 132 is guided by the support 133 which does not move vertically but rather pivots about the axis 131), a double-headed, vertically extending arrow 410 is provided in FIG. 6 to represent extension and retraction movements of the front wheel 132.

The fluid-operated cylinder 510 (described previously as having its upper end region 512 supported by the upwardly extending structure 700 of the carriage 110) is provided to extend and retract the front wheel 132 in directions that are indicated by the arrow 410. The cylinder 510 (see FIGS. 1 and 7–10) is interposed between the frame 120 and the wheel support structure 133 to pivot the support structure 133 about its axis 131 of connection with the frame 120 (see FIG. 10). The "retracted" position of the front wheel 132 is depicted in solid lines in FIG. 9 and in phantom in FIG. 6, as indicated by the numeral 94. When the front wheel 132 is retracted, it contributes in no way to the support of the machine 100, and does nothing to steer, drive or brake movements of the machine 100.

Two specific "extended" positions of the front wheel 132 find important use. In FIGS. 6–8 and 10, a first extended position of the front wheel 132 is indicated by the numeral 92. In FIG. 6 a second extended position of the front wheel 132 is indicated by the numeral 90.

Figure 7:
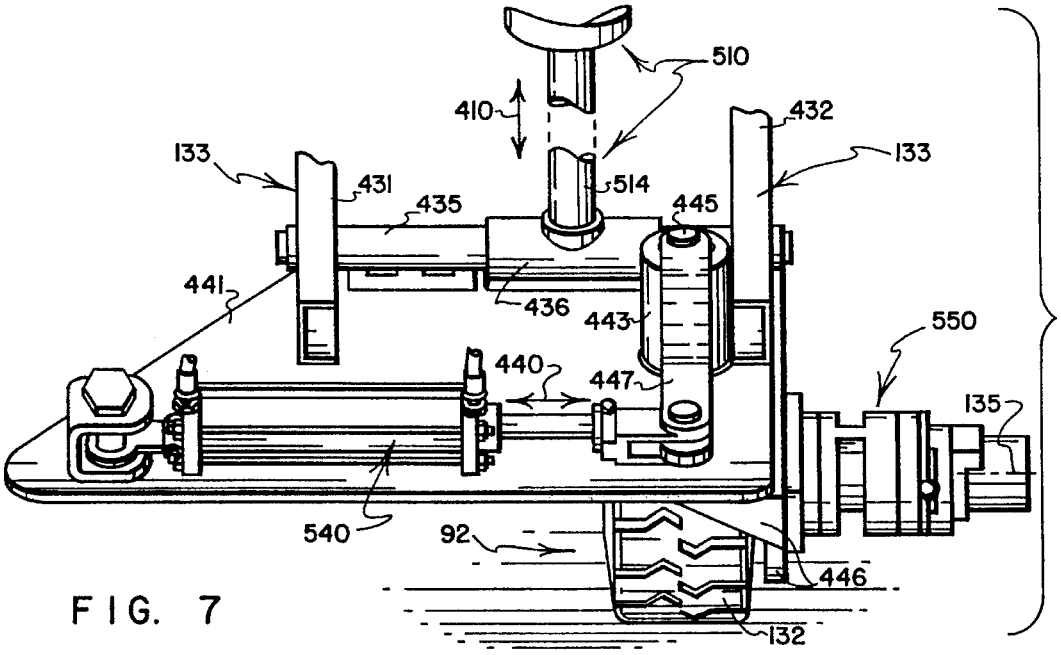
FIG. 7 is a perspective view on an enlarged scale showing components that serve to position, steer and drive the front wheel of the machine.
Figure 8:
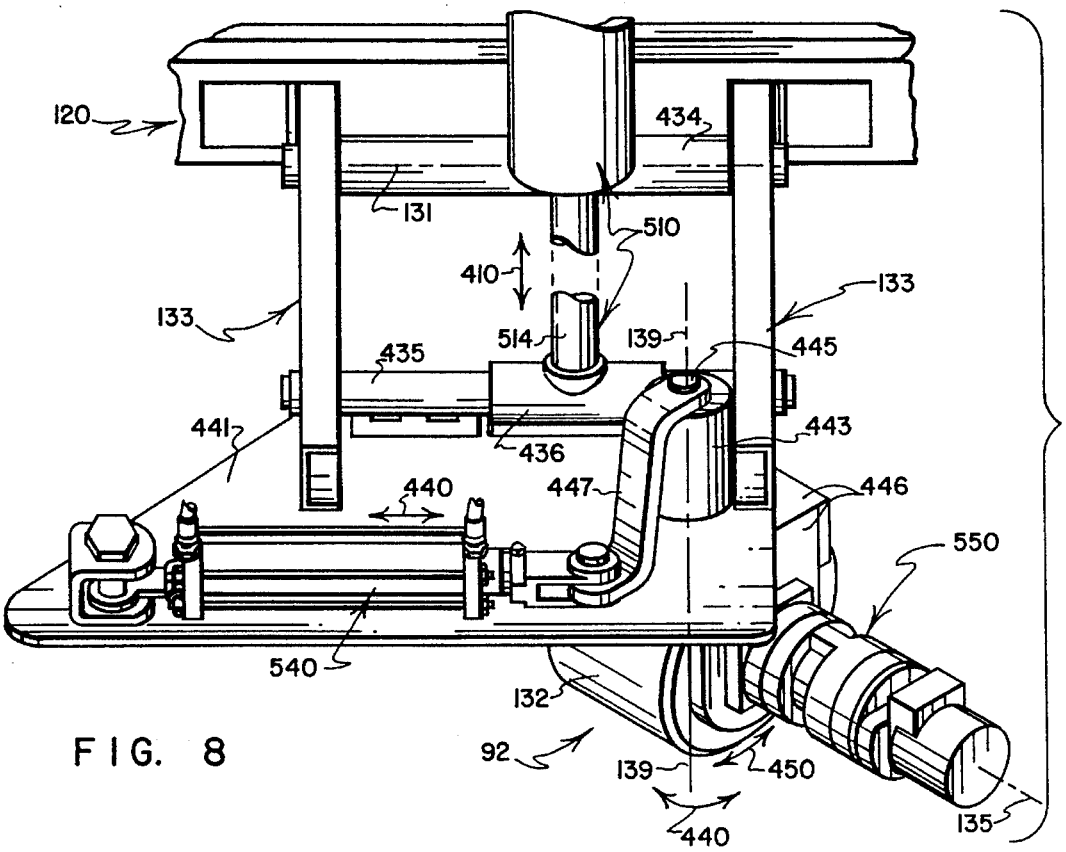
FIG. 8 is another perspective view of the components shown in FIG. 7, but with the front wheel turned as is typical during steering of the machine.

When the front wheel 132 is in the first extended position 92, a fluid-operated cylinder 540 (see FIGS. 7 and 8 wherein the cylinder 540 is seen to comprise one of several components of the wheel support structure 133) is provided to steer the front wheel 132 between left and right extremes of angular movement that are depicted by phantom rectangles 132L, 132R in FIG. 5. In FIG. 7 the cylinder 540 is shown positioning the front wheel 132 for "straight ahead" movement of the machine 100. In FIG. 8 the cylinder 540 is shown positioning the front wheel 132 for rightward/forward and leftward/reverse movements of the machine 100. In FIGS. 5 and 8, the axis about which the front wheel pivots to "steer" the machine 100 is identified by the numeral 139. Steering movements of the front wheel 132 are represented by the arrow 440 in FIGS. 5 and 8.

An important function that is performed by the front wheel 132 when the front wheel 132 is in the first extended position 92 is to cooperate with the transport wheels 136, 138 (best depicted in FIG. 6) to support the frame 120 at a height "A" above the traffic surface 102. When the front wheel 132 is in the first extended position 92, a fluid-operated motor 550 that is connected to the front wheel 132 (see FIGS. 7 and 8) can function 1) to rotate the front wheel 132 clockwise and counterclockwise (as represented by the double-headed arrow 450 in FIGS. 6 and 10) to drive the machine 100 generally forwardly and rearwardly, and 2) to brake movement of the machine 100.

Another important function that is performed by the front wheel 132 when the front wheel 132 is in the second extended position 90 is to cooperate with frame-carried, rear-mounted, extensible and retractable stabilization stands 166, 168 to support the frame 120 at a height "B" above a traffic surface that is indicated in FIG. 6 by the numeral 102'. The fluid-operated motor 550 functions to prevent rotation of the front wheel 132 when the front wheel 132 is in the second extended position 90—a braking action that is important inasmuch as it permits the extended front wheel 132 to complement the character of the immovable carriage support that is provided by the extended stabilization stands 166, 168 by effectively providing a third "stand" that aids in immovably supporting the carriage 110 with great stability.

In FIG. 5, a point at which support force is provided to the frame 120 by the front wheel 132 is indicated by the characters "WF." Points at which support force can be provided to the frame 120 by the retractable and extensible rear-mounted stabilization stands 166, 168 are indicated by the references "SL" and "SR," respectively. In FIGS. 3 and 4, fluid-operated cylinders that extend and retract the stabilization stands 166, 168 are identified by the numerals 520, 530, respectively; and, arrows that represent extension and retraction movements of the stands 166, 168 are identified by the numerals 420, 430, respectively.

When the machine 100 is supported by the left and right transport wheels 136, 138 and by the front wheel 132 (for maneuvering at a job site to position the machine 100 so that the center axis 210 of the rotary cutter bit 200 is brought into a desired position centered over a manhole that is to be "cored" by cutting a circular slot in pavement that surrounds the manhole), the three points at which the machine 100 is supported by the three wheels 136, 138, 132 are indicated in FIG. 5 by the references "WL," "WR" and "WF."

The three support points "WL," "WR" and "WF" can be thought of as defining the three vertices of an imaginary "maneuvering triangle" that is indicated by the numeral 103. Like the transport triangle 101, the maneuvering triangle 103 overlies principally the front half of the frame 120 in that the support force loci "WL," "WR" and "WF" are spaced substantially forwardly with respect to the location of the center axis 210 of the rotary core-cutter bit 200—which is quite a suitable support arrangement to utilize when the machine 100 is being maneuvered and positioned at a job site. The support force "WF" that is provided by the front wheel 132 for supporting a portion of the weight of the machine 100 is of a lesser magnitude than are the machine weight portions that are supported by each of the left and right transport wheels 136, 138. This lesser loading of the front wheel 132 is desirable when the machine 100 is being maneuvered because it permits the front wheel 132 to be steered relatively easily and helps to minimize tire wear that may result from steering movements of the front wheel 132.

When the machine 100 is supported by the left and right rear-mounted stabilization stands 166, 168 and by the front wheel 132 (for stabilizing and immovably supporting the frame 120—which is the support mode that is used when the rotary cutter bit is to be brought into service to "core" a manhole by cutting a circular slot in pavement that surrounds the manhole), the three points at which the machine 100 is supported by the stabilization stands 166, 168 and by the front wheel 132 are indicated in FIG. 5 by the references "SL," "SR" and "WF." The three support points "SL," "SR" and "WF" can be thought of as defining the three vertices of an imaginary "stabilization triangle" that is indicated by the numeral 105.

The transport, maneuvering and stabilization triangles 101, 103, 105 depicted in FIG. 5 are alike in that each is "acute" (each has no angle greater than ninety degrees); and each is substantially "isosceles" (each has two sides of substantially equal length). However, the stabilization triangle 105 does not share with the transport and support triangles 101, 103 the characteristics 1) of being positioned to overlie principally the front half of the frame 120, and 2) of being located such that all of its vertices are situated substantially forwardly with respect to the axis 210 of the rotary cutter bit 200. In complete contradistinction, the stabilization triangle 105 1) overlies much of the rear half of the frame 120, 2) has two of its vertices located rearwardly with respect to the axis 210, and 3) can reasonably be characterized as being "substantially centered about" the axis 210 of rotation of the cutter bit 200.

When the weight of the machine 100 is to be supported solely by the retractable and extensible stands 166, 168 and by the retractable and extensible front wheel 132, the type of carriage support that results is ideally suited to the provision of a stable platform on which the rotary bit 200 can be supported. The "three-point" support provided by the three extended members 166, 168, 132 distributes machine weight far more equally (to thereby provide a truly stable form of immovable support) than is provided when the machine 100 is movably supported by forces exerted at points that define the vertices of the transport and maneuvering triangles 101, 103.

By imposing the full weight of the machine 100 on the extended members 166, 168, 132 that form the stabilization triangle 105, an extraordinarily stable support platform is provided that has no predilection whatsoever to move from its fixed position on the traffic surface 102 during operation of the bit 200. Moreover, the attendant inertia of this highly stable support platform (inertia that stems from the large machine mass that is supported atop the extended members 166, 168, 132) is quite substantial and serves advantageously to dampen vibration and to resist movement.

Having described the three modes of "three point support" that are employed 1) during over-the-road transport of the machine 100, 2) during job-site maneuvering of the machine 100, and 3) during fixed-position stabilization and support of the cutting bit 200, there remain a number of additional details that are worthy of bringing to the attention of the reader regarding the character and arrangement of the various components that contribute to the provision of the above-mentioned and other features. The description that follows presents these additional details, and then turns to other topics such as the character of the rotary cutter bit 200 and the manner in which the rotary cutter bit 200 is movably supported by the frame 120 so as to further contribute to the operational stability of the bit 200.

In preferred practice, a conventional, commercially purchased axle assembly 134 (depicted in phantom in FIG. 5, but with portions also being seen in FIG. 1) extends beneath the left and right side regions 126, 128 of the frame 120 at a location spaced forwardly from the location of the core-cutting bit 200 to mount the left and right wheels 136, 138. The axle assembly 134 preferably has built-in hydraulically operated brakes (not shown) for braking rotation of the wheels 136, 138. The axle assembly 134 can be purchased from a variety of manufacturers, for example as Model No. 7650093 from Henschen Industrial Corp. of Jackson Center, Ohio 45334.

The hitch assembly 130 also can be purchased from a variety of manufacturers, for example as "Surg-O-Matic" Model No. 6 from Dico, Inc., of Des Moines, Iowa 50305. The type of hitch assembly 130 that preferably is purchased has a built-in actuator (not shown) for operating hydraulic brakes in response to load conditions that are sensed by the hitch assembly 130. The described type of hitch assembly 130 and axle assembly 134 can be used in combination to provide what is well known to those who are skilled in the art as a "hitch-actuated brake system" that will effect gentle braking of the wheels 136, 138 when a towing vehicle gently slows its rate of travel, and will effect more forceful braking of the wheels 136, 138 when the towing vehicle brakes more sharply. Hitch-actuated brake systems of this type are well known and accordingly form no part of the present invention.

The wheeled transport carriage 110 includes the retractable and extensible front wheel 132, portions of which are depicted in FIGS. 2 and 7–10. In FIG. 5, a solid-line rectangle (labeled "132") depicts the position of the front wheel 132 when the axis 133 of rotation 135 of the front wheel 132 extends transversely with respect to the frame 120 (i.e., when the front wheel axis 135 parallels the axis 137 of the left and right transport wheels 136, 138). Depicted in FIG. 5 by phantom rectangles 132L and 132R are left and right extremes of steering movement of the front wheel 132 about the steering axis 139.

As is best seen in FIGS. 5 and 6, the front wheel 132 is spaced rearwardly from the front end region 122 of the frame 120 by a distance that equals about one-fourth of the length of the frame 120. While the FIG. 5 depiction of the front wheel 132 shows the front wheel 132 located at a position that is substantially centered between the left and right side regions 126, 128 of the frame, it will be understood that the actual location of the front wheel 132 can differ by a matter of a few inches from the location that is depicted in FIG. 5 without detrimentally affecting the character of support that is afforded by the front wheel 132.

Figure 9:
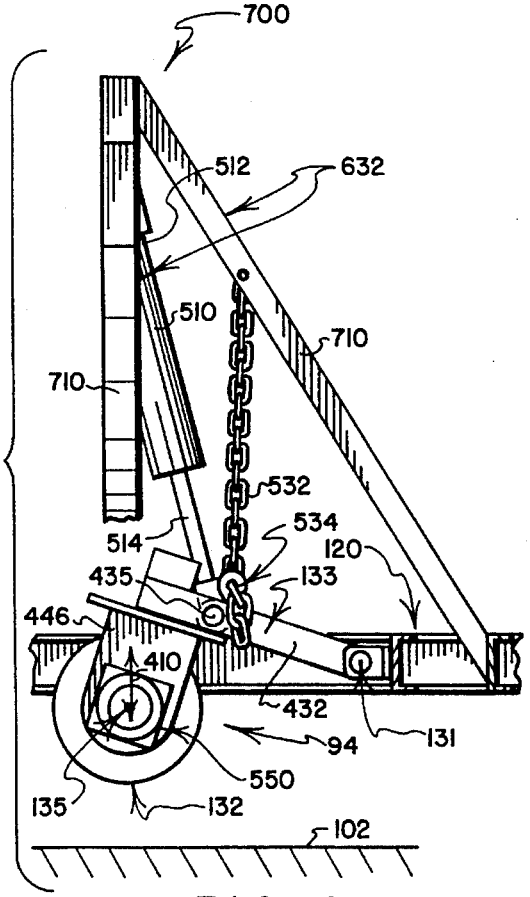
FIG. 9 is a side elevational view on an enlarged scale illustrating a manner in which a safety chain can be connected to front wheel assembly components to releasably retain the front wheel of the machine in its retracted position.
Figure 10:
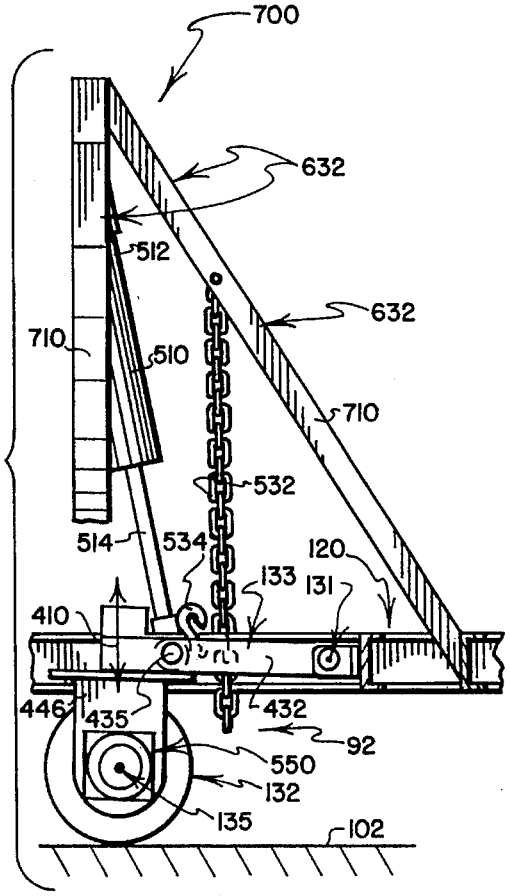
FIG. 10 is a side elevational view similar to FIG. 9 but showing the safety chain disconnected and the front wheel moved to an extended position.

As is shown in FIG. 9 (and depicted schematically in FIG. 6), the front wheel 132 can be retracted to a "transport" or "machine-towing" position that is indicated by the numeral 94. Referring to FIGS. 9 and 10, a safety chain 532 is connected to one of the brace members 710 of the upstanding frame-supported structure 700. A hook 534 is connected to the front wheel support structure 133 for engaging the safety chain 532 (as is depicted in FIG. 9). When the safety chain 532 is engaged by the hook 534, the front wheel 132 is retained in its retracted "transport" position 94. When the chain 532 is disconnected from the hook 534 (as is depicted in FIG. 10), the front wheel 132 can be extended to depend from the frame 120 to cooperate with other carriage supports (as has been previously described) to support the frame 120 at selected heights above the underlying traffic surface 102, as is indicated in FIG. 6 by the numerals 90 and 92.

Referring to FIGS. 7 and 8, the structure 133 that mounts the front wheel 132 on the frame 120 includes a pair of spaced, forwardly-rearwardly extending arms 431, 432 that are interconnected at their forward end regions by a sleeve 434 that extends along the pivot axis 131, and at their rearward end regions by a rod 435. A sleeve 436 is mounted on the rod 435 and is attached to the ram 514 of the fluid-operated cylinder 510—which provides a connection that permits the cylinder 510 to pivot the arms 431, 432 about the pivot axis 131 to retract and extend the front wheel 132 relative to the frame 120.

As is also shown in FIGS. 7 and 8, a trapezoidal shaped plate 441 is connected to the arms 431, 432 for movement with the arms 431, 432 when the arms 431, 432 pivot about the axis 131. A cylindrical member 443 is welded to the plate 441. Aligned holes (not shown) are formed through the cylindrical member 443 and through the plate 441 for journaling a shaft 445 for rotation about the steering axis 139 of the front wheel 132. A yoke 446 that rotatably mounts the front wheel 132 is connected to the lower end region of the shaft 445. A dog-legged arm 447 is connected to the upper end region of the shaft 445. The fluid-operated cylinder 540 is connected to the plate 441 and to the arm 447 for steering the front wheel 132 by pivoting the shaft 445 about the steering axis 139.

As also is best seen in FIGS. 7 and 8, the fluid-operated motor 550 is connected to and supported by the yoke 446, and serves to drive the front wheel 132 by rotating the front wheel 132 about its center axis (see the axis identified by the numeral 135 in FIG. 7). The fluid-operated motor 550 is a commercially purchased unit that is selected to also have a capability to brake the front wheel 132 against rotation. Such motors can be purchased from a variety of sources, for example as Model No. KFS2263-01 from Kraft Fluid Controls, Cleveland, Ohio 44136.

As is shown in FIGS. 3 and 4, safety retaining members 566, 568 are provided for being releasably mounted on side parts 126, 128 of the frame 120 for underlying portions of the retracted stabilization stands 166, 168 to ensure that the stands 166, 168 do not inadvertently extend during transit of the machine 100. Because the safety retaining members 566, 568 are identical, the character of both of the safety members 566, 568 can be understood by referring to FIGS. 16 and 17 wherein features of only one of the safety members 568 are illustrated.

Figure 16:
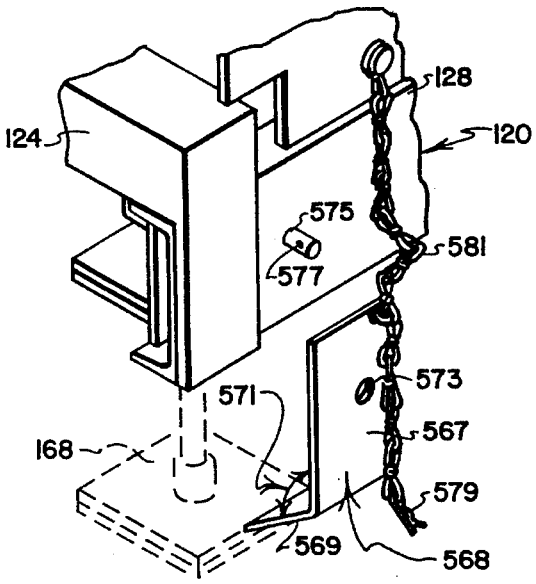
FIG. 16 is a perspective view on an enlarged scale showing portions of a right rear portion of the machine including portions of one of the machine's stabilization support stands extended, and showing stand safety retainer components.
Figure 17:
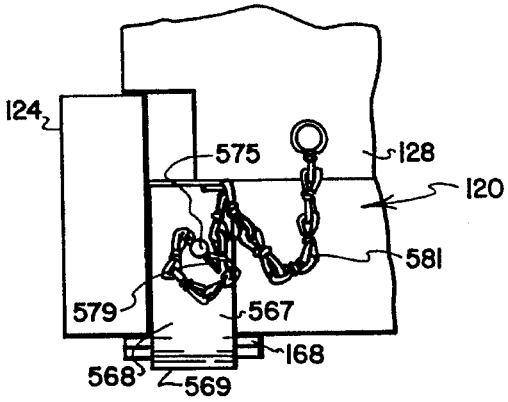
FIG. 17 is a side elevational view of the components depicted in FIG. 16 but with the safety retainer components ensuring that the stand does not move out of its retracted position.

Referring to FIGS. 16 and 17, the safety member 568 has a pair of integrally formed legs 567, 569 that are inclined with respect to each other at an obtuse angle 571 of about one hundred ten degrees. A hole 573 is formed through the upstanding leg 567 to receive a pin-like projection 575 that is formed on the right part 128 of the frame 120. A small hole 577 is formed through the pin-like projection 575 to receive a safety clip 579 to retain the safety member 568 on the frame 120 when the safety member 568 is positioned as depicted in FIGS. 3 and 17 with its transverse leg 569 underlying the base of the stand 168. A chain 581 is connected to the frame 120, to the safety member 568, and to the safety clip 579 to prevent loss of the safety member 568 and the safety clip 579.

The Core-Cutting Bit 200 and Its Supports

The core-cutting bit 200 is a generally cylindrical structure having a cylindrical steel wall 201. Referring to FIGS. 4 and 6, the cylindrical wall 201 has an outer surface 202 and an inner surface 203 that are separated by a bit thickness of about one-half to three-fourths inch. The outer surface 203 of the cylindrical wall is typically about forty eight inches in diameter, and typically has a height of about eighteen inches.

Figure 15:
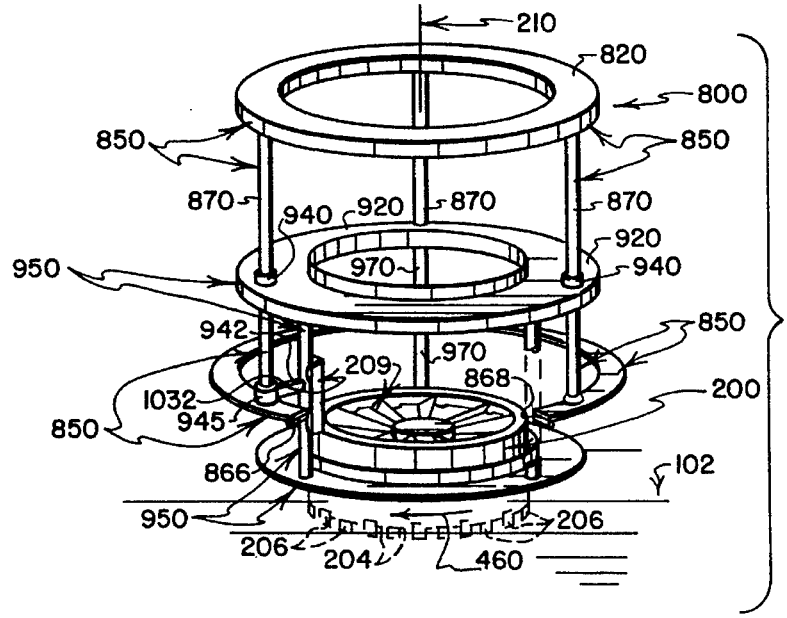
FIG. 15 is a schematic perspective view similar to FIGS. 13 and 14 but depicting components of the machine as the components typically are positioned when a coring cut has nearly been completed by the machine.

As is best seen in FIGS. 4, 6 and 15, the bit 200 has a downwardly-facing cutting edge 204 that carries a circumferentially spaced set of depending tooth formations 206 that preferably comprise durable, replaceable cutting segments supported by holders that are welded to the cylindrical wall 201. The holders and cutting segments can be purchased from a number of sources, for example from Dynatech Systems, Inc. of Weston, Ohio 44044. The material of the cutting segments preferably includes abrasive industrial diamond material that can be purchased from a number of sources such as the Superabrasives Division of General Electric Co., Columbus, Ohio 43329.

Referring to FIGS. 4 and 5, the core-cutting bit 200 has a vane-carrying, generally circular top surface 209 surrounded by an upstanding rim 211 that is defined, at least in part, by the upper end region of the cylindrical wall 201. An array of radially extending vanes 212 is provided for channeling radially outwardly a flow of cooling water that is directed onto the top surface 209 while the bit 200 is rotating during a coring operation. The vanes 212 are configured so that, when the bit 200 is being rotated in the direction indicated by arrows 460, cooling water delivered onto the top surface 209 will be directed radially outwardly, and thence downwardly through openings 214 so that a plurality of flows of water that move downwardly along the inner surface 203 of the cylindrical wall 201 of the bit 200 are fed to the vicinity of the tooth formations 206 to effect cooling and to flush away debris that results from the cutting operation as a circular slot 199 (see FIG. 6) is cut in pavement of an underlying traffic surface (labeled 102' in FIG. 6).

Referring to FIG. 4, a centrally located hub 215 is welded to the top surface 209 for receiving threaded fasteners 217 that releasably connect the bit 200 to a drive shaft 220 that extends upwardly along the center axis 210 from the bit 200. In preferred practice the fasteners 217 take the form of high strength cap screws that can be removed and reinstalled expeditiously when a bit 200 mounted on the drive shaft 220 is to be replaced by another bit.

Features of the machine 100 that facilitate bit replacement include 1) the fact that the bit 200 is supported by the carriage 110 at a location that is spaced rearwardly from the transversely extending axle assembly 134, and 2) the fact that the rear part 124 of the frame 120 extends transversely between left and right sides of the frame 120 at height that is greater than the height of most of the rest of the frame 120. These features permit bit replacement to take place in the following manner:

1) First, a bit 200 that is mounted on the drive shaft 220 is lowered into engagement with the traffic surface 102 that underlies the machine 100 so as to "park" the bit 200 on the traffic surface 102;
2) Second, the bit mounting fasteners 217 are removed to disconnect the parked bit 200 from the drive shaft 220, and the drive shaft 220 is raised to disengage the parked bit 200;
3) Third, the machine 100 is moved in a forward direction of travel such that the relatively high rear part 124 of the frame 120 is caused to pass over the parked bit 200—whereby the machine 100 is moved away from the place where the removed bit 200 is parked;
4) Fourth, the machine 100 is moved in a reverse direction of travel such that the relatively high rear part 124 of the frame 120 is caused to pass over a replacement bit 200 that also is parked on the traffic surface 102; and,
5) Fifth, the drive shaft 220 is lowered into engagement with the hub 215 of the replacement bit 200, and the bit mounting fasteners 217 are installed to properly drivingly connect the replacement bit 200 to the drive shaft 220—which completes the bit replacement process.

Referring to FIG. 4, a water supply conduit 575 is shown supported atop the vaned top surface 210 of the bit 200. The conduit 575 has an upper end region 577 that is configured to be connected to a water supply hose (not shown), and a lower end region 579 that is oriented and positioned so as to discharge water onto the vaned top surface 209 for being ducted in the manner described above by the vanes 212 and the openings 214 to the region of the tooth formations 206 to wash away debris and cool the bit 200 during coring operations.

Referring to FIGS. 3–4 and 13–15, a telescopically nestable and extendable set of cage-like structures is employed to provide desirable types of "three point" support to the vertically movable and rotatable bit 200. An outer cage-like structure 850 includes the upper ring-shaped member 820 to which upper end regions of the braces 810 connect to rigidly support the ring-shaped member 820 on the frame 120; and a lower ring-shaped segment 860 that underlies the upper ring-shaped member 820 but does not form a complete circle because the ring-shaped segment 860 does not extend across the rear of the machine 100—for, if it were to extend across the rear of the machine 100, it would provide exactly the kind of low-level obstruction that must be avoided if the type of bit-changing capability that is described above is to be provided by the machine 100. In FIG. 4, opposite ends of the segment 860 (that provide a space therebetween through which a parked bit 200 can pass during a bit replacement procedure of the type described above) are indicated by the numerals 866, 868.

Figure 13:
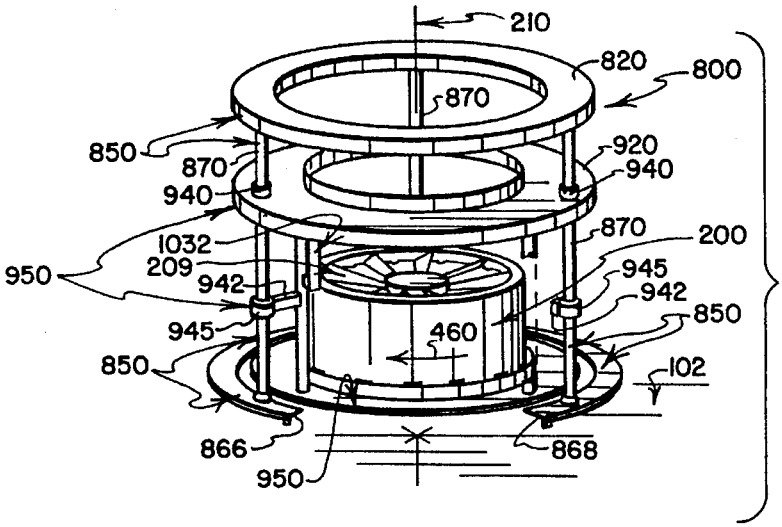
FIG. 13 is a schematic perspective view depicting relatively movable bit support components in their transport positions.
Figure 14:
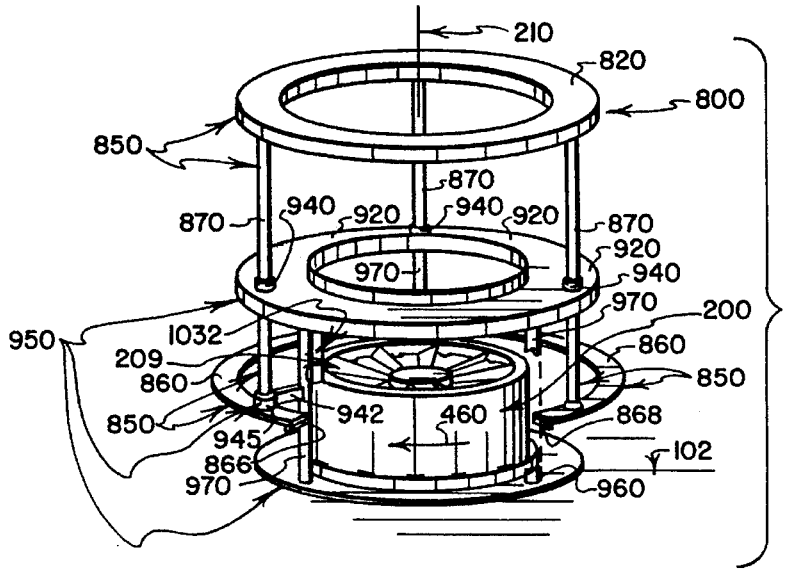
FIG. 14 is a schematic perspective view similar to FIG. 13 but depicting selected components of the machine positioned for initiating a coring cut.

Referring principally to FIGS. 13–15, also forming important components of the outer cage-like structure 850 are three upstanding posts 870 that connect with the upper ring-shaped member 820 at their upper ends, and with the lower ring-shaped segment 860 at their lower ends. The posts 870 are equidistantly and equiangularly arrayed about the center axis 210, and define three "outer tracks" along which an inner cage-like structure 950 can travel as the inner cage-like structure moves vertically along the center axis 210.

The inner cage-like structure 950 has an upper ring-shaped member 920, a lower ring-shaped member 960, and three upstanding posts 970 that extend between and connect the upper and lower ring-shaped members 920, 960 while being equidistantly and equiangularly arrayed about the center axis 210. Vertical movements of the inner cage 950 are guided by sliding connections that are provided between the inner cage 950 and the posts 870 of the outer cage 850. Referring to FIGS. 4 and 13–14, it will be seen that the upper ring 920 of the inner cage 950 defines sleeve-like formations 940 that encircle and establish sliding connections with the posts 870. Additionally, arms 942 that extend radially outwardly from the posts 970 of the inner cage 950 also define sleeve-like formations 945 that encircle and establish sliding connections with the posts 870. By this arrangement, the inner cage 950 can move upwardly relative to the outer cage 850 to the "transport" position that is illustrated in FIGS. 3 and 4 (and that is depicted schematically in FIG. 13); and can move downwardly relative to the outer cage 850 to a "fully down" position that is illustrated schematically in FIGS. 14 and 15.

Figure 18:
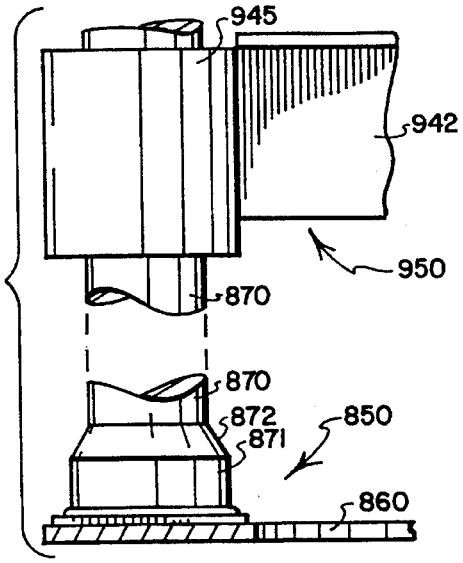
FIG. 18 is a side elevational view on an enlarged scale showing relatively movable components of the rotary cutter bit support system in a position that is intermediate their range of permitted relative movement.
Figure 19:
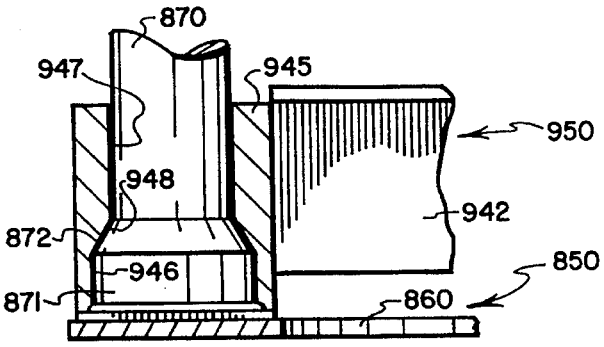
FIG. 19 is a view similar to FIG. 18 but with component portions broken away and/or shown in cross section, and with the relatively movable components at one end of their range of permitted relative movement.

When the inner cage 950 is "fully down," the sleeve-like formations 945 that are carried by the arms 942 of the inner cage 950 come to rest adjacent the circular ring segment 860 of the outer cage 850. Referring to FIGS. 18 and 19, bottom end regions 871 of the posts 870 are of enlarged diameter, and a tapered surface 872 is defined by the upper end region of each of the enlarged diameter end regions 871. Referring to FIG. 19, an enlarged diameter end region 946 is defined by the post-receiving opening 947 of each of the sleeve-like formations 945; and a tapered surface 948 is defined at the upper end of the enlarged diameter region 871. Each of the tapered surfaces 872 are configured to matingly engage a separate one of the tapered surfaces 948 when the inner cage 950 reaches its "fully down" position.

A feature that is associated with the provision of the mating surfaces 872, 948 is that, when the inner cage 950 is "fully down" relative to the outer cage 850, a play-eliminating, relative-movement-eliminating type of connection is formed by the mating tapered surfaces 872, 948 that contributes to the stable manner in which the rotary bit 200 is supported by the telescopically nested, relatively movable cage structures 850, 950. This stable connection of "three point" character tends to be maintained by virtue of the weight of the bit 200 (and other bit-connected structure that remains to be described) being supported by the interengaging tapered surfaces 872, 948.

Referring to FIG. 3, three horizontally extending arms 1030 are arrayed equiangularly about the axis 210 to provide components of a bit-mounting structure 1050 that is movably supported by the inner cage-like structure 950 for mounting the bit 200. Referring to FIGS. 3 and 4, outer ends of the arms 1030 connected with caged roller assemblies 1032 that each mount a pair of rollers 1034 that engage the posts 970 of the inner cage 950 to mount the arms 1030 for movement along the axis 210 relative to the inner cage 950. When the arms 1030 are "fully raised" with respect to the surrounding inner cage 950, the caged roller assemblies 1032 engage the upper ring 920 of the inner cage structure 950.

Referring to FIGS. 3 and 4, the arms 1030 connect at their inner ends with a sleeve 1020 that houses bearings (not shown) that journal the drive shaft 220 that rotates the bit 200. The shaft 220 extends upwardly from the sleeve 1020 to a location where it drivingly connects with the fluid-operated motor 560 that is provided for imparting rotary movement to the bit 200 (relative to the carriage 110 and the cage structures 850, 950) about the axis 210 in a direction that is indicated by the arrow 460.

Extending upwardly from the radial arms 1030 near inner ends of the arms 1030 is a welded assembly of spacer blocks 1040 that are capped by an annular plate 1042. The fluid-operated bit rotation motor 560 has its housing rigidly connected to the annular plate 1042 by suitable fasteners (not shown).

Figure 12:
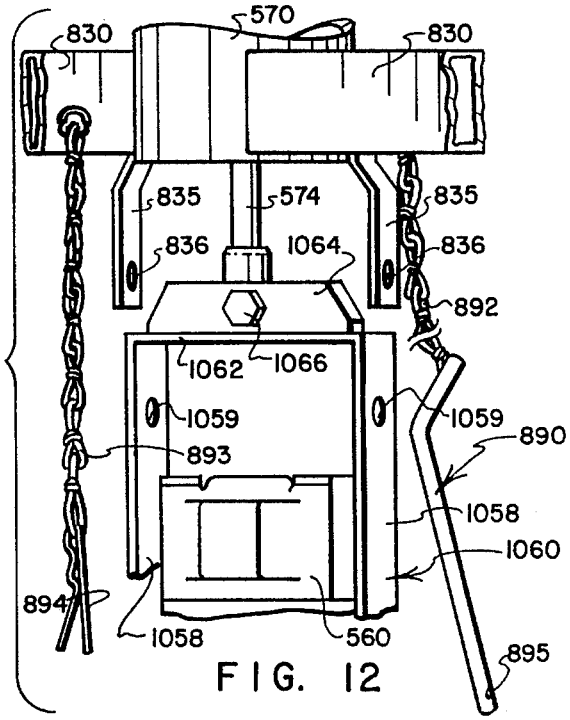
FIG. 12 is a side elevational view similar to FIG. 15 but showing the pinned connection released.

Referring to FIGS. 4 and 12, extending upwardly from the annular plate 1042 along opposite sides of the fluid-operated motor 560 are spaced, parallel-extending legs 1058 of a U-shaped yoke 1060. Lower end regions of the legs 1058 are welded to the annular plate 1042 (see FIG. 4). Upper end regions of the legs 1058 are interconnected by a transversely extending base 1062 of the U-shaped yoke 1060 (see FIG. 12).

Referring to FIG. 12, a bracket 1064 is welded to the upper surface of the the base 1062 of the yoke 1060. A threaded fastener 1066 connects the bracket 1064 to a downwardly extending ram 574 of the fluid-operated cylinder 570.

Figure 11:
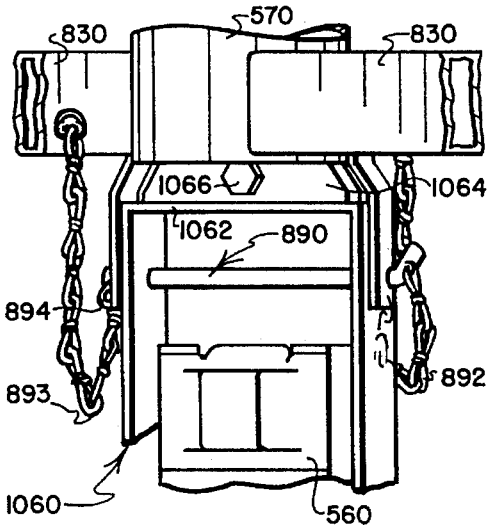
FIG. 11 is a side elevational view on an enlarged scale illustrating a manner in which a movable inner cage structure that assists in supporting the rotary cutter bit can be releasably pin-connected to hold the inner cage structure in an elevated position that will permit the bit to move downwardly without accompanying movement of the inner cage structure.

Referring to FIGS. 11 and 12, a pair of spaced arms 835 depend from the region where the radially extending arms 830 of the upstanding structure 800 join with the housing 571 of the fluid-operated cylinder 570. Holes 836 are formed through the spaced arms 835 for aligning with holes 1059 that are formed through the legs 1058 of the yoke 1060 when the bit 200 has been fully raised by the fluid-operated cylinder 570. When the holes 836, 1059 are aligned, an elongate transport retainer pin 890 can be inserted through the aligned holes 836, 1059 (as is depicted in FIG. 12) to retain the bit 200 in its "fully raised" or "transport" position for over-the-road travel of the machine 100.

Because the caged roller assemblies 1034 engage the underside of the ring 920 of the inner cage 950 and lift the cage 950 as the bit 200 is raised to its transport position, the pin 890 also serves, when installed as depicted in FIG. 11, to hold the inner cage 950 in its "fully raised" or "transport" position when the bit 200 is being held in its "fully raised" or "transport position" (as is shown in FIGS. 3 and 4, and depicted schematically in FIG. 13). When the fluid-operated cylinder 570 extends its ram 574 to lower the bit 200 from its "fully elevated" position, the weight of the inner cage 950 resting on the caged roller assemblies 1034 will cause the inner cage 950 and the bit 200 to descend in unison until the "fully lowered" position of the inner cage 950 is reached (as is depicted in FIG. 14)—wherein the interfitting tapered surfaces 872, 948 of the rods 870 and the sleeves 945 engage (see FIG. 19) to support the inner cage 950 from the outer cage 850, thereby preventing further descent of the inner cage 950 relative to the outer cage 850. As the bit 200 is further lowered by extension of the ram 574 of the cylinder 570, the bit 200 extends beneath the lower ring 950 of the inner cage 850 for cutting a circular slot in pavement of the underlying traffic surface 102, as is depicted in FIG. 15.

Referring to FIGS. 11 and 12, a chain 892 is connected to one of the arms 830 for keeping the transport parking pin 890 close at hand when the pin 890 is not being used to retain the bit 200 in its transport position. Another chain 893 is connected to one of the arms 830 for supporting a safety pin 894. A hole 895 (see FIG. 12) is formed through the transport parking pin 890 to receive the safety pin 894 so that the safety pin 894 can hold the parking pin 890 in place, as is depicted in FIG. 11.

Referring to FIGS. 3 and 4, at three equally spaced locations about the periphery of the cutting bit 200, bit alignment guides 1200 (only two are depicted in each of FIGS. 3 and 4) are provided that utilize the rigidity of the lower ring 960 to guide and stabilize rotation of the bit 200 about its center axis 210. Referring to the cross-sectional depiction of one of the alignment guides 1200 that is provided in FIG. 4, each of the guides 1200 has a tubular body 1202 that is welded to the lower ring 960 in alignment with a hole 1204 that is formed by an upstanding portion 961 of the lower ring 960. A positioning bolt 1205 is threaded into the outer end region of the tubular body 1202. A brass rod 1207 is positioned in the inner end region of the tubular body 1202 and extends through the hole 1204 to engage the outer surface 202 of the rotating bit 200.

By adjusting the position of the bolt 1205 relative to the body 1202, the brass rod 1207 is positioned to engage the bit 200 and to guide its rotation. A lock nut 1209 is provided to secure the position of the bolt 1205 relative to the body 1202. As the brass rods 1207 wear away, the bolts 1205 will, from time to time, need to be adjusted—and, periodically, the rods 1207 will need to be replaced. Replacement of the rods 1207 typically is attended to when one bit 200 is to be replaced by another bit 200, in the manner that has been described above.

As will be apparent to those who are skilled in the art, the sets of three rods 870, 970 that provide supports to relatively movable members that move along the rods 870, 970; the set of three interfitting pairs of tapered surfaces 872, 948 that engage when the inner cage 950 is fully lowered with respect to the outer cage 850; and the three sets of alignment guides 1200 that are interposed between the inner cage 950 and the bit 200 serve to support, position and guide relatively movable members of the machine 100 in something of a "three point" manner that tends to provide optimum stability in the manner in which the bit 200 is supported for operation.

Because the selection and provision of hydraulic lines such as hoses that have proper pressure ratings and flow delivery characteristics is a subject that is well understood by those who are skilled in the art, it is not necessary to clutter the drawings with the depictions of, and with numerals that designate such hydraulic lines as are utilized to duct hydraulic fluid to and from the pump 310, the reservoir 320, the various fluid-operated cylinders and motors that have been identified above, and the various controls that are depicted in FIG. 20. Portions of such hoses are depicted in many of the views of the accompanying drawings, with other portions cut away to permit more meaningful features to be shown with clarity.

Operation of the Machine 100

In operation, the machine 100 typically is towed (by using the hitch 130) by a motor vehicle (not shown) to a job site where the machine 100 is to be moved from the location of one manhole to another to form circular cuts in pavement of an underlying traffic surface that extends about manhole castings. During towing, the machine 100 is supported by the left and right transport wheels 136, 138, and by the hitch 130, as has been described. Upon arrival at a job site, the engine 300 is electrically started to bring the fluid-operated controls (depicted in FIG. 20) of the machine 100 into service.

Before disconnecting the hitch 130 from a towing vehicle, the safety chain 532 (that is provided, as shown in FIGS. 9 and 10, for ensuring that the front wheel 132 is held retracted in its "transport" position during over-the-road travel of the machine 100) is disconnected from the hook 534, and the control lever 610 (FIG. 20) is utilized to operate the hydraulic cylinder 510 to lower the front wheel 132 in the direction of the arrow 410 to its "normal" position 92 (FIGS. 2, 6–8 and 10) so that the front end region of the machine 100 will be suitably supported when the hitch 130 is disconnected from a towing vehicle.

To position the machine 100 at a desired location overlying a manhole 50 (see FIG. 3) for "coring" the manhole 50 by cutting a circular slot in pavement of the traffic surface 102 that surrounds the manhole 50, either the machine positioning control levers 640, 650 or the joystick lever 645 of the portable control 360 are utilized to cause the fluid-operated cylinder 540 and the fluid-operated motor 550 to steer and drive the front wheel 132, as is indicated in FIGS. 5 and 8 by the arrows 440, 540, respectively.

To ready the machine 100 for cutting, the safety members 566, 568 are withdrawn from positions (FIGS. 2, 3 and 17) wherein they ensure that the power-operated stabilization stands 166, 168 are held retracted during transport of the machine 100, and are positioned so as to be out of the way of the operation of the stabilization stands 166, 168 (see FIGS. 4 and 16). Likewise, the parking pin 890 (see FIG. 11) that ensures that the inner cage 950 and the bit 200 retain their transport positions during over-the-road transport of the machine 100 is removed to the out-of-the-way position that is depicted in FIG. 12.

To further ready the machine 100 for cutting, the control levers 610, 620, 630 (FIG. 20) are utilized to operate the fluid-operated cylinders 510, 520, 530 as indicated by arrows 410, 420, 430 (see FIGS. 4 and 6) to extend the front wheel 132 and the stabilization stands 166, 168 to engage the traffic surface 102 and to raise the frame 120 to the elevated height indicated by the dimension "B" in FIG. 6. If, in positioning one or both of the stabilization stands 166, 168, the operator deems it desirable to make use of one or both of the portable supports 266, 268 (see FIG. 1) that normally are carried on the front end region 122 of the frame 120, one or both of the supports 266, 268 can be used in combination with one or both of the stands 166, 168 (as is depicted in FIG. 4 wherein the support 266 is shown interposed between the stand 166 and the traffic surface 102).

When the stands 166, 168 and the front wheel 132 have been extended to wholly support the full weight of the machine 100 (i.e., the left and right transport wheels 136, 138 have been lifted out of engagement with the traffic surface 102), the machine 100 is nearly ready to begin a cutting operation.

Before actual cutting is begun, a hose (not shown) for delivering a flow of cooling water to the bit 200 is connected to or inserted into the water supply conduit 575 (see FIG. 4) for ducting a supply of cooling water onto the vaned upper surface 209 of the bit 200. Because the speed of rotation of the cylindrical bit is controlled as a function of engine speed, and inasmuch as a cutting operation normally is begun by rotating the bit at its maximum speed of rotation, the throttle of the engine 300 is operated to set the speed of the engine 300 set sufficiently "high" to give a normal speed of bit rotation that is within the desired range of about 80 to about 110 RPM. The operator then takes a position near the control panel 350 for controlling the conduct of a cutting operation.

Cutting is begun by utilizing the control lever 660 (FIG. 20) to operate the fluid-operated motor 560 to rotate the bit 200 as is indicated by the arrow 460, and by rotating the bit descent control knob 670D (FIG. 20) counter-clockwise to operate the fluid-operated cylinder 560 to lower the bit 200 as indicated by the arrow 460 to a position wherein the inner cage 950 is fully lowered (as is depicted in FIGS. 14 and 15), whereafter the rotary position of the knob 670D is adjusted so that the bit 200 will continue to descend at a desired rate of movement during the cutting of a circular slot in the traffic surface 102. During cutting, the bit 200 will extend beneath the bottom ring 960 of the inner cage 950 to bring the tooth formations 206 of the bit 200 into cutting engagement with the traffic surface 102, and the cooling water that is supplied by the conduit 575 will be ducted by the vanes 212 and openings 214 of the bit 200 to the region where cutting is taking place to cool the teeth 206 and to flush away debris.

During cutting, an "appropriate" rate of bit descent is set so that cutting takes place with a reasonable degree of speed but without undue bit wear, and without overloading the ability of the engine 300, the hydraulic pump 310 and the hydraulic motor 560 to rotate the bit 200. One way of monitoring the operation of the bit 200 to set its rate of descent properly is to listen to the sound of its operation and to the sounds made by the various operational components of the machine 100 during cutting to ensure that operation is proceeding in a way that is known to an experienced operator to be satisfactory.

Another way in which the desirable character of a cutting operation can be monitored is by use of a pressure gage that is interposed in a hydraulic line that delivers hydraulic fluid to the motor 560—to check the pressure at which fluid is being delivered to the motor 560. For this purpose, a pressure gage 1100 is provided on the control panel 350 (or located elsewhere as may be preferred) that will measure up to about 3000 pounds per square inch, with a mid-range measurement of about 1500 normally being indicative of the conduct of a proper type of cutting operation.

Cutting action proceeds in a normal fashion until the desired depth of cut has been achieved. While the thickness of the pavement through which a cut is to be completed often is known—whereby cutting to a preestablished depth is deemed satisfactory to effect a completed cut—there often are other factors that can be relied upon by the operator to determine when a through cut has been completed. For example, the pressure gauge 1100 usually reflects a significant drop in cutting pressure when a through-cut has been completed; and, the "wash" content of cooling water that drains away from the area of the bit 200 often noticeably changes color when a through-cut has been completed.

Once a desired depth of cut has been achieved, the operator uses the lever 660 to stop blade rotation, discontinues the flow of cooling water, uses the lever 670U to operate the cylinder 570 in the direction of arrow 470 to raise the cutting bit 200, throttles the engine 300 to idle, uses the levers 610, 620, 630 to raise the front wheel 132 and the stands 166, 168 so that the machine 100 is again supported by the front wheel 132 and the transport wheels 136, 138 at a height indicated in FIG. 6 by the dimension "A," and uses either the control levers 640, 650 or 645 to steer and drive the machine 100 to a next desired operating position.

Once operator proficiency has been attained, the entire process from set-up to completion of a cut and readying the unit for movement to the next cutting location typically requires an average of about eleven to about twelve minutes. Most operators find that maneuvering and positioning the machine 100 at a job site is best effected by utilizing the portable control 360, and by standing several feet from the machine 100 so that movements of the machine 100 in relation to surrounding objects can be observed to ensure safety.

Although the invention has been described in its preferred form with a certain degree of particularity, it is understood that the present disclosure of the preferred form has been made only by way of example and that numerous changes in the details of construction may be resorted to without departing from the spirit and scope of the invention as hereinafter claimed. It is intended that the patent shall cover, by suitable expression in the appended claims, whatever features of patentable novelty exist in the invention disclosed.

What is claimed is:

1. A machine for cutting circular slots in traffic surface pavement extending about pavement-embedded castings and the like, comprising:

a) a transport carriage including a frame having a front part, a rear part, a left part and a right part that all are rigidly connected;

b) rotary cutter means for being rotated about a substantially vertically extending center axis to cut a circular slot at a desired location in pavement of a substantially horizontally extending traffic surface;

c) cutter operating means connected to the frame and to the rotary cutter means for mounting the rotary cutter means on the frame, for raising the rotary cutter means relative to the transport carriage to a transport position wherein the rotary cutter means does not interfere with movement of the machine across the traffic surface, and for operating the rotary cutter means by rotating the rotary cutter means about the substantially vertically extending center axis while lowering the rotary cutter means relative to the transport carriage to bring the rotary cutter means into engagement with traffic surface pavement for cutting a circular slot therein; and, d) carriage support means, including:

i) at least five support members connected to the frame at spaced locations for supporting the frame above a traffic surface;

ii) transport support means for causing a selected set of three of the five support members to cooperate to movably support the frame atop the traffic surface so that the machine can move from place to place; and, iii) operation support means for causing a different set of three of the five support members to cooperate to immovably support the frame atop the traffic surface at a desired location so that the machine is held in place at said desired location when the rotary cutter means is being operated to cut a circular slot.

2. The machine of claim 1 additionally including power drive means supported by the frame, and control means connected to the power drive means and to the cutter operating means for delivering power to the cutter operating means to selectively raise, lower and rotate the rotary cutter means relative to the transport carriage.

3. The machine of claim 2 wherein at least one of the support members of the selected set is steerable relative to the frame, and the control means also is connected to said at least one of the support members of the selected set for steering the machine during movement of the machine from place to place.

4. The machine of claim 3 wherein the control means includes hand-held means for being held in the hand of an operator who has taken a position spaced from the transport carriage for steering and moving the machine in response to input given by the operator to the hand-held means.

5. The machine of claim 4 wherein the control means includes frame-carried means that is connected to the hand-held means by flexible signal transmitting means for communicating a control signal between the frame-carried means and the hand-held means in response to said operator input.

6. The machine of claim 4 wherein the hand-held means includes a base and at least one base-carried control for receiving operator input for steering and moving the machine in response thereto.

7. The machine of claim 1 additionally including power drive means supported by the frame, and control means connected to the power drive means and to the selected set of support members for selectively delivering power to the support members of the selected set to move the machine from place to place.

8. The machine of claim 1 additionally including hitch means connected to the frame near the front part of the frame for coupling the machine to a motor vehicle for being towed by the motor vehicle when the machine is being movably supported by at least two of the support members of the selected set.

9. The machine of claim 1 wherein the support members of the selected set of are configured to support the frame above the traffic surface at one height, and the support members of the different set are configured to support the frame above the traffic surface at a different height.

10. The machine of claim 9 wherein said different height is greater than said one height, and wherein all three of the support members of said different set are extensibly connected to the frame for depending beneath the frame to support the frame at said different height, two of the support members of said selected set are non-extensibly connected to the frame for supporting the frame at said one height, and the extension of the three support members of said different set to position the frame at said different height causes said two of the support members of said selected set to be raised out of engagement with the traffic surface.

11. The machine of claim 10 additionally including power drive means supported by the frame, and control means connected to the power drive means and to the three support members of said different set for extending and retracting the three support members of said different set relative to the frame for raising and lowering the frame between said one height and said different height.

12. The machine of claim 10 wherein one of the five support members includes extensible and retractable wheel means that is movably connected to the frame for depending from the frame to engage the traffic surface to support the frame at said one height when said one of the support members comprises one of said selected set of support members, and to engage the traffic surface to support the frame at said different height when said one of the support members comprises one of said different set of the support members.

13. The machine of claim 12 additionally including power drive means supported by the frame, and control means connected to the power drive means and to the extensible and retractable wheel means for extending and retracting the extensible and retractable wheel means for selectively supporting frame between at said one height and said different height.

14. The machine of claim 12 additionally including power drive means supported by the frame, and control means connected to the power drive means and to the extensible and retractable wheel means for rotating the extensible and retractable wheel means for selectively moving the machine from place to place when a part of the weight of the machine is being supported by the extensible and retractable wheel means.

15. The machine of claim 12 additionally including power drive means supported by the frame, and control means connected to the power drive means and to the extensible and retractable wheel means for steering and for rotating the extensible and retractable wheel means for selectively moving and guiding the movement of the machine from place to place when a part of the weight of the machine is being supported by the extensible and retractable wheel means.

16. The machine of claim 15 wherein the control means includes hand-held means for being held in the hand of an operator who has taken a position spaced from the transport carriage for steering and rotating the extensible and retractable wheel means in response to input given by the operator to the hand-held means.

17. The machine of claim 16 wherein the control means includes frame-carried means that is connected to the hand-held means by flexible signal transmitting means for communicating a control signal between the frame-carried means and the hand-held means in response to said operator input.

18. The machine of claim 16 wherein the hand-held means includes a base and at least one base-carried control for receiving operator input for steering and rotating the extensible and retractable wheel means in response thereto.

19. The machine of claim 12 additionally including power operated brake means connected to the extensible and retractable wheel means for being operated to retain the machine in a fixed position when a portion of the weight of the machine is being supported by the extensible and retractable wheel means.

20. The machine of claim 1 wherein:

a) the frame means is configured to support the rotary cutter means in a manner that causes said center axis to be located rearwardly with respect to the locations of the three support members of said selected set; and, b) the frame means is configured to support the rotary cutter means in a manner that causes said center axis to be located substantially centrally among the three support members of said different set so that the weight of the machine is more equally distributed among the support members of said different set when said different set of support members supports the machine than is the case when said selected set of support members supports the machine.

21. The machine of claim 20 wherein the three support members of said selected set include a steerable front wheel connected to the frame near its front part, a left transport wheel connected to the frame near its left part, a right transport wheel connected to the frame near its right part, an engine connected to the frame for providing a source of rotary energy, and control means connected to the engine and to the steerable front wheel both for steering the front wheel and for driving the front wheel for moving the machine from place to place when the frame is supported by the support members of said selected set.

22. The machine of claim 21 wherein the control means includes hand-held means for being held in the hand of an operator who has taken a position spaced from the transport carriage for steering and driving the front wheel in response to input given by the operator to the hand-held means.

23. The machine of claim 22 wherein the control means includes frame-carried means that is connected to the hand-held means by flexible signal transmitting means for communicating a control signal between the frame-carried means and the hand-held means in response to said operator input.

24. The machine of claim 22 wherein the hand-held means includes a base and at least one base-carried control for receiving operator input for steering and driving the front wheel in response thereto.

25. The machine of claim 21 additionally including means for braking rotation of at least a selected one of the front, left and right wheels.

26. The machine of claim 21 wherein the control means also is connected to the cutter operating means for delivering power to the cutter operating means to selectively raise, lower and rotate the rotary cutter means relative to the transport carriage.

27. The machine of claim 21 additionally including positioning means interposed between the frame and the steerable front wheel for extensibly and retractably mounting the steerable front wheel, and wherein the control means also is connected to the positioning means for selectively operating the positioning means to extend and retract the steerable front wheel relative to the frame to raise and lower at least the front end region of the frame.

28. The machine of claim 1 wherein:

a) said at least five support members includes at least six support members;

b) one of said selected set of support members includes hitch means connected to the front part of the carriage for enabling the machine to be connected to a motor vehicle for towing the machine during over-the-road travel and for transferring to a motor vehicle that is connected to the hitch means a part of the weight of the machine during towing of the machine; and, c) one of said different set of support members includes retractable wheel means that is movably connected to the frame for being extended to support a part of the weight of the machine when said hitch means is not connected to a motor vehicle, and for being retracted to support no part of the weight of the machine when said hitch means is connected to a motor vehicle.

29. The machine of claim 1 additionally including retractable stand means connected to the frame for being retracted to not interfere with movement of the machine, and for being extended to support a part of the weight of the machine.

30. The machine of claim 1, wherein:

a) the rotary cutter means defines downwardly extending cutting formation means for engaging and for cutting a circular slot in traffic surface pavement that extends beneath the rotary cutter means;

b) the rotary cutter means defines upwardly extending fluid receiving means for ducting a flow of water from the fluid receiving means to a location where the cutting formation means engages traffic surface pavement to form a circular slot therein; and, c) conduit means is connected to the carriage means for receiving a flow of water from a source thereof and for ducting said flow of water to the fluid receiving means for being received and ducted to said location where the cutting formation means is forming a circular slot.

31. The machine of claim 1 wherein the cutter operating means includes:

a) first cage-like means for defining a first upstanding, generally cylindrical cage-like structure that is rigidly connected to the frame and extends substantially concentrically about the center axis of the rotary cutter means at a first diameter that is greater than the diameter of a circular slot that is to be cut in traffic surface pavement by said rotary cutter means;

b) second cage-like means for defining a second upstanding, generally cylindrical cage-like structure i) that is connected to the first cage-like structure for vertical movement along the center axis of the rotary cutter means, and ii) that extends substantially concentrically about the center axis of the rotary cutter means at a second diameter that is less than the first diameter and is greater than the diameter of a circular slot that is to be cut in traffic surface pavement by said rotary cutter means; and, c) guide means carried by the second cage-like means for engaging the rotary cutter means to guide the rotation of the rotary cutter means to ensure that such rotation does not vary from rotation about said center axis.

32. A machine for cutting circular slots in traffic surface pavement extending about pavement-embedded castings and the like, comprising:

a) a transport carriage including a substantially rigid frame;

b) rotary cutter means for being rotated about a substantially vertically extending center axis to cut a circular slot at a desired location in pavement of a substantially horizontally extending traffic surface;

c) cutter operating means connected to the frame and to the rotary cutter means for mounting the rotary cutter means on the frame, for rotating the rotary cutter means about the substantially vertically extending center axis, for raising the rotary cutter means relative to the transport carriage to a transport position wherein the rotary cutter means is held out of engagement with traffic surface pavement that extends beneath the frame, and for lowering the rotary cutter means relative to the transport carriage while the rotary cutter means is being rotated about the center axis so that the rotary cutter means can engage pavement of the traffic surface at said desired location to cut a circular slot therein; and, d) carriage support means connected to the frame including first, second and third wheels that depend from the frame to engage the traffic surface at first, second and third spaced locations, respectively, to suitably support the machine for movement across the traffic surface so that the frame can be moved as needed to position the rotary cutter means overlying said desired location, and including frame stabilization means for depending beneath the frame toward the traffic surface for supporting the machine during operation of the rotary cutter means by engaging the traffic surface at first, second and third spaced positions that define an imaginary acute triangle that extends about the center axis.

33. The machine of claim 32 wherein:

a) the frame is substantially rectangular and has a front part, a rear part, a left part and a right part, with all of the front, rear, left and right parts being rigidly interconnected; and, b) the first wheel is connected to the frame by first wheel mounting structure that defines the first location where the first wheel engages the traffic surface as being substantially centered between the left and right parts of the frame, and being more closely located to the front part of the frame than to the rear part of the frame.

34. The machine of claim 33 wherein the second and third wheels are connected to the frame by second and third wheel mounting structures, respectively, with the second wheel mounting structure being connected to the left part of the frame so as to define the second location where the second wheel engages the traffic surface as being situated nearer to the left part of the frame than to the right part of the frame, with the third wheel mounting structure being connected to the right part of the frame so as to define the third location where the third wheel engages the traffic surface as being situated nearer to the right part of the frame than to the left part of the frame, and with the first, second and third wheel mounting structures being connected to the frame such that, when the first, second and third wheels support the machine for movement across the traffic surface, the portion of the weight of the machine that is supported by the first wheel is substantially less than the portions of the weight of the machine that are supported by each of the second and third wheels.

35. The machine of claim 32 wherein:

a) the frame is substantially rectangular and has a front part, a rear part, a left part and a right part, with all of the front, rear, left and right parts being rigidly interconnected; and, b) the frame stabilization means is configured such that the first position where the frame stabilization means engages the traffic surface to support the machine during operation of the rotary cutter means to form a circular slot in traffic surface pavement is substantially centered between the left and right parts of the frame, and is more closely located to the front part of the frame than to the rear part of the frame.

36. The machine of claim 35 wherein the frame stabilization means is configured a) such that the second position where the frame stabilization means engages the traffic surface to support the machine during operation of the rotary cutter means is situated nearer to the left part of the frame than to the right part of the frame, b) such that the third position where the frame stabilization means engages the traffic surface to support the machine during operation of the rotary cutter means is situated nearer to the right part of the frame than to the left part of the frame, and c) such that the weight of the machine is more equally distributed during operation of the rotary cutter means among supports at the first, second and third positions than is the distribution of the weight of the machine among wheels at the first, second and third locations when the machine is being supported by the first, second and third wheels.

37. The machine of claim 32 wherein the stabilization means includes a) first means connected to the frame and to the first wheel for adjusting the extent to which the first wheel depends beneath the frame and for selectively positioning the first wheel to extend beneath the frame to engage the traffic surface at the first position, b) second means connected to the frame for being extended to depend from the frame to engage the traffic surface at the second position, c) third means connected to the frame for being extended to depend from the frame to engage the traffic surface at the third position, d) with the first, second and third means being operable when extended sufficiently to support the machine solely by engagements with the traffic surface at the first, second and third positions to cause the second and third wheels to be raised out of engagement with the traffic surface.

38. The machine of claim 32 wherein the frame stabilization means is configured to locate the first, second and third positions such that the imaginary acute triangle that is defined by the locations of the first, second and third positions has two sides of substantially equal length that connect the first position with each of the second and third positions.

39. The machine of claim 32 additionally including:

a) hitch means connected to the frame at a location that is nearer to a chosen one of the first, second and third wheels than to either of the others of the first, second and third wheels for enabling the machine to be hitch-towed by a motor vehicle; and, b) wheel retraction means connected to said chosen one of the wheels for retracting the chosen one of the wheels from engaging the traffic surface after the hitch means has been connected to a motor vehicle for towing.

40. The machine of claim 39 additionally including a fluid-operated motor connected to the chosen one of the wheels for rotating the chosen one of the wheels when the chosen one of the wheels engages the traffic surface to sequentially position the machine on the traffic surface at a series of desired locations where circular slots are to be cut in traffic surface pavement.

41. The machine of claim 40 additionally including fluid-operated means connected to the frame and to the selected wheel for steering the selected wheel when the selected wheel engages the traffic surface to aid in positioning the machine on the traffic surface.

42. The machine of claim 41 additionally including control means connected to the fluid-operated motor and to the fluid-operated means for providing controlled flows of fluid to the fluid-operated motor and to the fluid-operated means for steering and rotating the chosen one of the wheels, with the control means including hand-held means for being held in the hand of an operator who has taken a position spaced from the transport carriage for steering and rotating the selected wheel in response to input given by the operator to the hand-held means.

43. The machine of claim 42 wherein the control means includes frame-carried means that is connected to the hand-held means by flexible signal transmitting means for communicating a control signal between the frame-carried means and the hand-held means in response to said operator input.

44. The machine of claim 43 wherein the hand-held means includes a base and at least one base-carried control for receiving operator input for steering and rotating the selected wheel in response thereto.

45. The machine of claim 41 additionally including pressurized fluid supply means connected to the frame for delivering a controlled flow of pressurized fluid to the fluid-operated motor and to the fluid-operated means for operating the fluid-operated motor and the fluid-operated means to maneuver the machine on the traffic surface.

46. The machine of claim 45 wherein the pressurized fluid supply means includes a hydraulic pump connected to the frame, a hydraulic reservoir for supplying hydraulic fluid to the hydraulic pump, conduit means for ducting hydraulic fluid among the pump, the motor and the reservoir as required to effect rotation of the chosen one of the wheels, and an engine connected to the frame for operating the hydraulic pump.

47. The machine of claim 39 additionally including power operated brake means connected to said chosen one of the wheels for being operated to retain the machine in a fixed position when a portion of the weight of the machine is being supported by said chosen one of the wheels.

48. The machine of claim 32 additionally including retractable stand means connected to the frame for being retracted to not interfere with movement of the machine, and for being extended to support a part of the weight of the machine.

49. The machine of claim 32, wherein:

a) the rotary cutter means defines downwardly extending cutting formation means for engaging and for cutting a circular slot in traffic surface pavement that extends beneath the rotary cutter means;

b) the rotary cutter means defines upwardly extending fluid receiving means for ducting a flow of water from the fluid receiving means to a location where the cutting formation means engages traffic surface pavement to form a circular slot therein; and, c) conduit means is connected to the carriage means for receiving a flow of water from a source thereof and for ducting said flow of water to the fluid receiving means for being received and ducted to said location where the cutting formation means is forming a circular slot.

50. The machine of claim 32 wherein the cutter operating means includes:

a) first cage-like means for defining a first upstanding, generally cylindrical cage-like structure that is rigidly connected to the frame and extends substantially concentrically about the center axis of the rotary cutter means at a first diameter that is greater than the diameter of a circular slot that is to be cut in traffic surface pavement by said rotary cutter means;

b) second cage-like means for defining a second upstanding, generally cylindrical cage-like structure i) that is connected to the first cage-like structure for vertical movement along the center axis of the rotary cutter means, and ii) that extends substantially concentrically about the center axis of the rotary cutter means at a second diameter that is less than the first diameter and is greater than the diameter of a circular slot that is to be cut in traffic surface pavement by said rotary cutter means; and, c) guide means carried by the second cage-like means for engaging the rotary cutter means to guide the rotation of the rotary cutter means to ensure that such rotation does not vary from rotation about said center axis.

51. A machine for cutting circular slots in traffic surface pavement extending about pavement-embedded castings and the like, comprising:

a) a transport carriage including a frame having a front part, a rear part, a left part and a right part that all are rigidly connected;

b) carriage support means including:

i) hitch means connected to the front part of the carriage for enabling the machine to be connected to a motor vehicle for towing the machine during over-the-road travel, and for enabling a motor vehicle that is connected to the hitch means to support a part of the weight of the machine during towing of the machine;

ii) transport wheel means including at least one left wheel connected to the left part of the carriage and at least one right wheel connected to the right part of the carriage for supporting a majority of the weight of the machine when the hitch means is connected to and being towed by a motor vehicle;

iii) retractable front wheel means movably connected to the front part of the carriage for being extended to depend from the frame to support a part of the weight of the machine when the hitch means is not connected to a motor vehicle, and for being retracted to not support part of the weight of the machine when the machine is being towed;

iv) retractable stand means including a left retractable stand connected to at least one of the left and rear parts of the frame, and a right retractable stand connected to at least one of the right and rear parts of the frame for being retracted with respect to the frame to not interfere with movement of the machine, and for being extended to depend from the frame when the retractable front wheel means also is extended for cooperating with the front wheel means to elevate the frame sufficiently to relieve the left and right wheels from supporting machine weight, and to thereby provide substantially a three-point fixed-position support for the machine; and, c) rotary cutter means for being rotated about a substantially vertically extending center axis to cut a circular slot at a desired location in pavement of a substantially horizontally extending traffic surface; and, d) cutter operating means connected to the frame and to the rotary cutter means for mounting the rotary cutter means on the frame such that the vertically extending center axis is located rearwardly with respect to the left and right wheels and rearwardly with respect to the front wheel, for raising the rotary cutter means relative to the transport carriage to an elevated position wherein the rotary cutter means does not interfere with movement from place to place of the machine, and for concurrently 1) rotating the rotary cutter means about the substantially vertically extending center axis and 2) lowering the rotary cutter means relative to the transport carriage 3) while the machine is being supported by said three-point support to bring the rotary cutter means into engagement with said pavement for cutting a circular slot therein.

52. The machine of claim 51 additionally including power operated drive means connected to the retractable front wheel means for rotating the front wheel means when the weight of the machine is being supported by the transport wheel means and the retractable front wheel means to move and position the machine.

53. The machine of claim 51 additionally including power operated steering means connected to the retractable front wheel means for steering the front wheel means when the weight of the machine is being supported by the transport wheel means and the retractable front wheel means to guide movements of the machine.

54. The machine of claim 51 additionally including power operated brake means connected to the retractable front wheel means for being operated to hold the machine in a fixed position when a portion of the weight of the machine is being supported by the retractable front wheel means.

55. The machine of claim 51 wherein the left and right wheels are located on opposite left and right sides of the machine, and are connected to the frame in such a way as to be rotatable about a substantially horizontally extending transport axis that is located nearer to the front part of the machine than is the vertically extending center axis about which the rotary cutter means rotates, and the vertically extending center axis is located nearer to the front part of the machine than are the left and right retractable stands.

56. The machine of claim 55 wherein:

a) the rotary cutter means includes a hollow, generally cylindrical rotary bit having a generally circular lower region that carries tooth formations for cutting through pavement to form a circular slot, and a generally circular upper region that is configured to be releasably connected to the cutter operating means;

b) releasable connection means is provided for releasably connecting the upper region of the rotary bit to the cutter operating means; and, c) the rear part of the frame is supported by the transport wheel means and by the retractable front wheel means at a height that is sufficient to permit the rear part of the frame to pass over the upper region of the generally cylindrical rotary bit when the bit has been parked atop a traffic surface on which the machine is supported by the transport wheel means and by the retractable front wheel means, and when the releasable connection means has been released to disconnect the rotary bit from the cutter operating means.

57. A machine for cutting circular slots in traffic surface pavement extending about pavement-embedded castings and the like, comprising:

a) a transport carriage including a frame having a front part, a rear part, a left part and a right part that all are rigidly connected;

b) carriage support means connected to the carriage for supporting the machine for movement across a substantially horizontally extending traffic surface, and for supporting the machine atop the traffic surface at a desired location where a circular slot is to be cut in traffic surface pavement portions that underlie the machine;

c) rotary cutter means for being rotated about a substantially vertically extending center axis to cut a circular slot in said pavement portions at said desired location;

d) cutter operating means connected to the frame and to the rotary cutter means for mounting the rotary cutter means on the frame, for raising the rotary cutter means relative to the carriage support means to an elevated position wherein the rotary cutter means does not interfere with movement of the machine across the traffic surface, and for rotating the rotary cutter means about said substantially vertically extending center axis while lowering the rotary cutter means relative to the transport carriage to bring the rotary cutter means into engagement with said pavement portions for cutting a circular slot therein;

e) with the cutter operating means including:

i) first track-defining means connected rigidly to the frame including at least three elongate members for extending substantially vertically at locations spaced about the periphery of the rotary cutter means for defining a first set of substantially vertically extending tracks;

ii) first track-engaging means including a plurality of first track-engaging members for engaging the first set of tracks for being moved vertically along the lengths of the first set of tracks;

iii) cutter mounting means connected to the first track-engaging means for interconnecting the first track-engaging means for concurrent movement along the first set of tracks and for being connected to the rotary cutter means for raising and lowering the rotary cutter means as the cutter mounting means is moved upwardly and downwardly along the first track-defining means; and, f) with the cutter operating means also including power operated means connected to the cutter mounting means and to the rotary cutter means for rotating the rotary cutter means about said center axis relative to the cutter mounting means.

58. The machine of claim 57 wherein the cutter mounting means also includes:

a) second track-defining means connected to the first track-engaging means for moving vertically along the first set of tracks, with the second track-defining means including at least three elongate structures for extending substantially vertically at locations spaced about the periphery of the rotary cutter means for defining a second set of substantially vertically extending tracks;

b) a plurality of second track-engaging structures for engaging the second set of tracks for being moved vertically along the lengths of the second set of tracks; and, c) cutter-connected means connected to the second track-engaging means for interconnecting the second track-engaging means for concurrent movement along the second set of tracks and for being connected to the rotary cutter means for raising and lowering the rotary cutter means as the cutter-connected means is moved upwardly and downwardly along the second track-defining means.

59. The machine of claim 58 additionally including power-operated cutter positioning means connected to cutter-connected means for raising and lowering the cutter-connected means relative to at least one of the first track-defining means and the second track-defining means.

60. The machine of claim 58 additionally including:

a) power-operated cutter positioning means interposed between the first track-defining means and the cutter positioning means for raising and lowering both of the second track-defining means and the cutter-connected means relative to the first track-defining means;

b) with the second track-defining means being movable relative to the first track-defining means between a raised position wherein the second track-defining means is telescopically nested within the confines of the first track-defining means, and a lowered position wherein the second track-defining means extends beneath the first track-defining means; and, c) releasable locking means interposed between the first and second track-defining means for releasably latching the second track-defining means in its raised position so that the power-operated cutter positioning means can raise and lower the cutter-connected means relative to the second track-defining means.

61. The machine of claim 60 wherein:

a) the rotary cutter means includes a relatively tall, hollow cylindrical structure that extends concentrically about the vertically extending center axis and carries cutting teeth on its circular lower edge for forming a circular slot in pavement located beneath the machine, with the circular slot extending to a depth that disconnects a circular slot surrounded core of pavement from pavement that extends about the periphery of the circular slot;

b) releasable connection means for releasably connecting replaceable rotary cutter means one at a time to the power operated means; and, c) the carriage support means supports the rear part of the frame at a height sufficient to enable the rear part of the frame to pass over one replaceable rotary cutter means that has been disconnected by the releasable connection means from the power operated means, and to enable the rear part of the frame to also pass over another replaceable rotary cutter means that is to be connected to the power operated means by the releasable connection means.

62. A method of cutting at least one circular slot in traffic surface pavement extending about at least one pavement-embedded casting and the like, comprising the steps of:

a) providing core-cutting apparatus having:

i) a transport carriage including a frame having a front part, a rear part, a left part and a right part that all are rigidly connected;

ii) rotary cutter means for being rotated about a substantially vertically extending center axis to cut a circular slot at a desired location in pavement of a substantially horizontally extending traffic surface;

iii) cutter operating means connected to the frame and to the rotary cutter means for mounting the rotary cutter means on the frame, for raising the rotary cutter means relative to the transport carriage to a transport position wherein the rotary cutter means does not interfere with movement of the machine across the traffic surface, and for operating the rotary cutter means by rotating the rotary cutter means about the substantially vertically extending center axis while lowering the rotary cutter means relative to the transport carriage to bring the rotary cutter means into engagement with traffic surface pavement for cutting a circular slot therein; and, iv) carriage support means, including:

A) at least five support members connected to the frame at spaced locations for supporting the frame above a traffic surface;

B) transport support means for causing a selected set of three of the five support members to cooperate to movably support the frame atop the traffic surface so that the machine can move from place to place; and, C) operation support means for causing a different set of three of the five support members to cooperate to immovably support the frame atop the traffic surface at a desired location so that the machine is held in place at said desired location when the rotary cutter means is being operated to cut a circular slot; and, b) moving the apparatus across a traffic surface while the carriage is supported by the transport support means to position the rotary cutter means for cutting a circular slot at a desired location in pavement that defines the traffic surface;

c) transferring the support of the carriage of the apparatus from the transport support means to the operation support means to immovably support the frame of the apparatus atop the traffic surface at the desired location where a circular slot is to be cut in pavement that underlies the rotary cutter means; and, d) operating the rotary cutter means while the operation support means immovably supports the frame of the apparatus to cut a circular slot by lowering the rotary cutter means along the center axis to bring the rotary cutter means into engagement with the traffic surface while rotating the rotary cutter means about the center axis.

63. The method of claim 62 additionally including cutting a second circular slot in traffic surface pavement by repeating the steps "a)" through "d)" but at a second desired location.

64. The method of claim 62 wherein:

a) the step of providing core-cutting apparatus includes the step of providing the transport support means such that i) two of the three support members of the selected set include left and right transport wheels that are connected to opposite sides of the frame, and such that ii) the remaining one of the three support members of the selected set includes a steerable front wheel that is connected to the frame at a location spaced forwardly from where the left and right transport wheels are connected to opposite sides of the frame; and, b) the step of moving the core-cutting apparatus across a traffic surface while the carriage is supported by the transport support means includes the steps i) of supporting the carriage of the apparatus by causing the front, left and right wheels to engage the traffic surface, and ii) of steering the front wheel to maneuver the core-cutting apparatus to position the rotary cutter means for cutting a circular slot at a desired location in pavement that defines the traffic surface.

65. The method of claim 64 wherein:

a) the step of providing core-cutting apparatus includes the step of providing the transport support means with power-operated drive and steering means for rotating and steering the front wheel; and, b) the step of moving the core-cutting apparatus across a traffic surface while the carriage is supported by the transport support means includes the step of operating the power-operated means to rotate and steer the front wheel to maneuver the core-cutting apparatus to position the rotary cutter means for cutting a circular slot at a desired location in pavement that defines the traffic surface.

66. The method of claim 65 wherein:

a) the step of providing core-cutting apparatus includes the steps of providing the transport support means i) with two of the three support means of the different set taking the form of power-operated extensible and retractable stands that are connected to the frame at spaced locations, and ii) with power-operated positioning means for extending and retracting the steerable front wheel relative to the frame so that the steerable front wheel can serve as a component of the selected set of support means to movably support the frame at a first height, and can serve as a component of the different set of support means to immovably support the frame by lifting the frame to a second height that is greater than the first height so that the left and right transport wheels are raised out of engagement with the traffic surface; and, b) the step of transferring the support of the carriage of the apparatus from the transport support means to the operation support means includes the step of operating the power-operated extensible and retractable stands and the power-operated positioning means to raise the frame from being supported by the selected set of support means at the first height so that the different set of support means cooperate to support the frame at the second height.

67. The method of claim 66 wherein the step of operating the power-operated drive and steering means to rotate and steer the front wheel to maneuver the core-cutting apparatus includes the steps i) of providing hand-held means for being held in the hand of an operator for permitting the operator to input maneuvering commands to the hand-held means for controlling the power-operated drive and steering means, and ii) of operating the hand-held means at a location spaced from the apparatus to input maneuvering commands to control and operate the power-operated drive and steering means to rotate and steer the front wheel to maneuver the core-cutting apparatus.

68. A method for cutting circular slots in traffic surface pavement extending about pavement-embedded castings and the like, comprising the steps of:

a) providing a core-cutting apparatus that includes:

i) a transport carriage including a substantially rigid frame;

ii) rotary cutter means for being rotated about a substantially vertically extending center axis to cut a circular slot at a desired location in pavement of a substantially horizontally extending traffic surface;

iii) cutter operating means connected to the frame and to the rotary cutter means for mounting the rotary cutter means on the frame, for rotating the rotary cutter means about the substantially vertically extending center axis, for raising the rotary cutter means relative to the transport carriage to a transport position wherein the rotary cutter means is held out of engagement with traffic surface pavement that extends beneath the frame, and for lowering the rotary cutter means relative to the transport carriage while the rotary cutter means is being rotated about the center axis so that the rotary cutter means can engage pavement of the traffic surface at said desired location to cut a circular slot therein; and, iv) carriage support means connected to the frame including first, second and third wheels that depend from the frame to engage the traffic surface at first, second and third spaced locations, respectively, to suitably support the machine for movement across the traffic surface so that the frame can be moved as needed to position the rotary cutter means overlying said desired location, and including frame stabilization means for depending beneath the frame toward the traffic surface for supporting the machine during operation of the rotary cutter means by engaging the traffic surface at first, second and third spaced positions that define an imaginary acute triangle that extends about the center axis; and, b) moving the apparatus across a traffic surface while the carriage is supported by the first, second and third wheels to position the rotary cutter means for cutting a circular slot at a desired location in pavement that defines the traffic surface;

c) transferring the support of the carriage of the apparatus from the first, second and third wheels to the frame stabilization means to immovably support the frame of the apparatus atop the traffic surface at the desired location where a circular slot is to be cut in pavement that underlies the rotary cutter means; and, d) operating the rotary cutter means while the frame stabilization means immovably supports the frame of the apparatus to cut a circular slot by lowering the rotary cutter means along the center axis to bring the rotary cutter means into engagement with the traffic surface while rotating the rotary cutter means about the center axis.

69. The method of claim 68 wherein the step of providing the core-cutting apparatus with carriage support means including frame stabilization means includes configuring the frame stabilization means i) such that the second position where the frame stabilization means engages the traffic surface to support the machine during operation of the rotary cutter means is situated nearer to the left part of the frame than to the right part of the frame, ii) such that the third position where the frame stabilization means engages the traffic surface to support the machine during operation of the rotary cutter means is situated nearer to the right part of the frame than to the left part of the frame, and iii) such that the weight of the machine is more equally distributed during operation of the rotary cutter means among supports at the first, second and third positions than is the distribution of the weight of the machine among wheels at the first, second and third locations when the machine is being supported by the first, second and third wheels.

70. A method for cutting circular slots in traffic surface pavement extending about pavement-embedded castings and the like, comprising the steps of:

a) providing cutting apparatus that includes:

i) a transport carriage including a frame having a front part, a rear part, a left part and a right part that all are rigidly connected;

ii) carriage support means including:

A) hitch means connected to the front part of the carriage for enabling the machine to be connected to a motor vehicle for towing the machine during over-the-road travel, and for enabling a motor vehicle that is connected to the hitch means to support a part of the weight of the machine during towing of the machine;

B) transport wheel means including at least one left wheel connected to the left part of the carriage and at least one right wheel connected to the right part of the carriage for supporting a majority of the weight of the machine when the hitch means is connected to and being towed by a motor vehicle;

C) retractable front wheel means movably connected to the front part of the carriage for being extended to depend from the frame to support a part of the weight of the machine when the hitch means is not connected to a motor vehicle, and for being retracted to not support part of the weight of the machine when the machine is being towed;

D) retractable stand means including a left retractable stand connected to at least one of the left and rear parts of the frame, and a right retractable stand connected to at least one of the right and rear parts of the frame for being retracted with respect to the frame to not interfere with movement of the machine, and for being extended to depend from the frame when the retractable front wheel means also is extended for cooperating with the front wheel means to elevate the frame sufficiently to relieve the left and right wheels from supporting machine weight, and to thereby provide substantially a three-point fixed-position support for the machine; and, iii) rotary cutter means for being rotated about a substantially vertically extending center axis to cut a circular slot at a desired location in pavement of a substantially horizontally extending traffic surface; and, iv) cutter operating means connected to the frame and to the rotary cutter means for mounting the rotary cutter means on the frame such that the vertically extending center axis is located rearwardly with respect to the left and right wheels and rearwardly with respect to the front wheel, for raising the rotary cutter means relative to the transport carriage to an elevated position wherein the rotary cutter means does not interfere with movement from place to place of the machine, and for concurrently A) rotating the rotary cutter means about the substantially vertically extending center axis and B) lowering the rotary cutter means relative to the transport carriage C) while the machine is being supported by said three-point support to bring the rotary cutter means into engagement with said pavement for cutting a circular slot therein; and, b) moving the apparatus across a traffic surface while the carriage is supported by the transport support wheel means and by the retractable front wheel means to position the rotary cutter means for cutting a circular slot at a desired location in pavement that defines the traffic surface;

c) transferring the support of the carriage of the apparatus from being supported by a combination of the transport support means and the retractable front wheel means to being supported by a combination of the retractable stand means and the retractable front wheel means to immovably support the frame of the apparatus atop the traffic surface at the desired location where a circular slot is to be cut in pavement that underlies the rotary cutter means; and, d) operating the rotary cutter means while the operation support means immovably supports the frame of the apparatus to cut a circular slot by lowering the rotary cutter means along the center axis to bring the rotary cutter means into engagement with the traffic surface while rotating the rotary cutter means about the center axis.

* * * * *